US006828033B1

(12) United States Patent
Bancroft et al.

(10) Patent No.: US 6,828,033 B1
(45) Date of Patent: Dec. 7, 2004

(54) COATING TECHNIQUE

(76) Inventors: G. Michael Bancroft, 62 Heathcote Ave., London, Ontario (CA), N6G 1V5; Masoud Kasrai, 1789 Phillbrook Ct., London, Ontario (CA), N5X 2Z3; Arthur Bzowski, 155 Hachborn Rd., Unit #3, Brantford, Ontario (CA), N3S 7W7; Marina S. Fuller, 2382 Schafer Ct., Bright's Grove, Ontario (CA), N0N 1C0; Kathy De Jong, 3712 Confederation Rd., Wyoming, Ontario (CA), N0N 1T0

( * ) Notice: Subject to any disclaimer, the term of this patent is extended or adjusted under 35 U.S.C. 154(b) by 0 days.

(21) Appl. No.: 09/723,301

(22) Filed: Nov. 27, 2000

Related U.S. Application Data

(63) Continuation-in-part of application No. 09/283,177, filed on Apr. 1, 1999, now Pat. No. 6,176,945.
(60) Provisional application No. 60/237,327, filed on Oct. 2, 2000, and provisional application No. 60/080,368, filed on Apr. 1, 1998.

(51) Int. Cl.[7] ..... B32B 15/04
(52) U.S. Cl. ..... 428/469; 428/472.3
(58) Field of Search ..... 428/469, 472.3

(56) References Cited

U.S. PATENT DOCUMENTS 2,643,962 A 6/1953 Lindhe
5,451,333 A 9/1995 Waddoups et al.

OTHER PUBLICATIONS

Merriam–Webster's Collegiate Dictionary, Tenth Edition, Merriam–Webster, Inc., 1998, pp. 46–47.*
Fuller et al. 'The Use of X–Ray Absorption Spectroscopy for Monitoring . . . ZDDP' 21 pgs., Apr. 22, 1999.
Fuller et al. 'Solution Decomposition of Zinc Dialkyl Dithiophosphate and its Effect . . . Spectroscopy' 18 pgs, 1998 (no month data).
Bancroft et al. 'Mechanisms of Tribochemical Film Formation: Stability of Tribo– and . . . Films' 5 pgs, 1997 (no month data).
Fuller et al. 'Chemical Characterization of Tribochemical and Thermal . . . Spectroscopy' 11 pgs, 1997 (no month data).
Ludema K. C. 'Friction, Wear, Lubrication' 4 pgs, 1997 (no month data).
Fuller et al. 'X–Ray Absorption Spectroscopy of Antiwear Films on . . . Dialkyldithiophosphate' 12 pgs, 1995 (no month data).
Rhodes K. L. and Stair P.C. 'The Effect of ZDP's on the Surface . . . Substrates' 8 pgs, 1993 (no month data).
Harrison P. G. and Brown P. 'External Refection FTIR, $^{31}$P MAS NMR and SEM . . . Steel' 12 pgs, 1991 (no month data).
Barcroft F. T. and Park D. 'Interactions on Heated Metal Surfaces Between . . . Additives' 22 pgs, 1986 (no month data).
Barcroft et al. 'The Mechanism of Action of Zinc Thiophosphates as . . . Agents' 30 pgs, 1982 (no month data).
Rounds F. G. 'Additive Interactions and Their Effect on the Performance . . . Dithophosphate' 11 pgs, 1978 (no month data).
Bird R. J. and Galvin G. D. 'The Application of Photoelectron Spectroscopy . . . Surface' 25 pgs, Sep. 25, 1975.

* cited by examiner

*Primary Examiner*—Andrew L. Oltmans
(74) *Attorney, Agent, or Firm*—Thomas A. O'Rourke; Bonner & O'Rourke

(57) ABSTRACT

Disclosed herein is a method of coating a substrate with a zinc dialkyldithiophosphate (ZDDP) material, comprising the steps of selecting a substrate which is reactive with said ZDDP material; providing an atmosphere containing said ZDDP material at a predetermined concentration; exposing said substrate to said atmosphere for a sufficient period of time and at a sufficient temperature, so as to cause said ZDDP material to form a layered substrate having a layer of a ZDDP derivative material thereon; and annealing said layered substrate.

3 Claims, 18 Drawing Sheets

S L-edge XANES Spectra of Thermal Films on A2 steel Generated from ZDDP-1 at 150° C for 6 hours, Before and After Annealing at Various Temperatures P K-edge Peak Height Increase with Increasing Immersion Time of Al alloy Coupons in the ZDDP Oil Solution Heated at 150° C, Indicating an Increase in Film Thickness Blank Steel 1 kg Annealed Film on Steel 5kg Blank Steel Annealed Phosphate Film on Steel 1800x 50,000x

| | |
|---|---|
| Size: | 2000 μM |
| Magnification: | 63 x |
| Resolution: | 128 pixels |
| Time Per Step: | 1 mSecs |
| Peak: | 0 eV |
| Multiplier: | 1000 V |
| Beam Voltage: | 3000 V |
| Beam Current: | 0.04 μA |

AUGER ANALYSIS INSIDE AND OUTSIDE OF THE SCRATCH CHANNEL

EDX Elemental Map

Annealed Phosphate Film
6 Kg Scratch Channel

PK

OK

Fe L

Zn L

Al Blank

Annealed Phosphate Film on Al

Before Test
(50,000x) (50,000x)

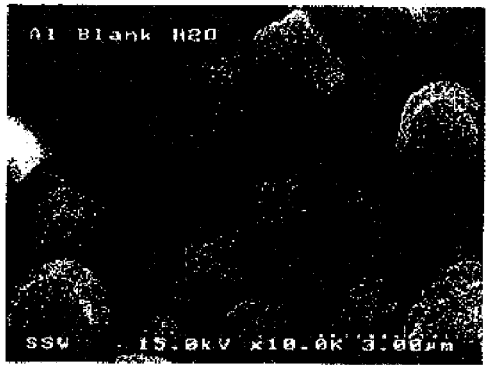
(10,000x)
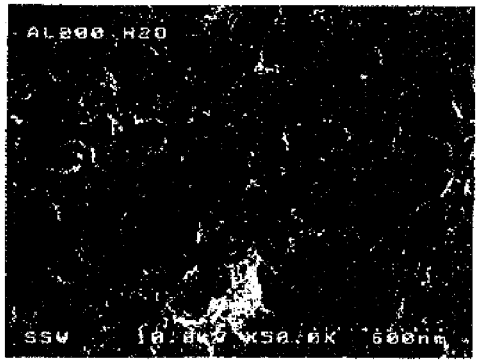
(50,000x)
After Test
[$H_2O$/85° C, 23 hours]
FIG. 13b
FIG. 13d

COATING TECHNIQUE

REFERENCE TO CO-PENDING APPLICATION

The subject matter of U.S. provisional patent application Ser. No. 60/080,368 filed Apr. 1, 1998 entitled COATING TECHNIQUE is incorporated herein by reference. The subject matter CIP of U.S. patent application Ser. No. 09/283,177 filed Apr. 1, 1999 entitled COATING TECHNIQUE now U.S. Pat. No. 6,176,945 is also incorporated herein by reference. The subject matter of U.S. provisional patent application Ser. No. 60/237,327 filed Oct. 2, 2000 entitled COATING TECHNIQUE is also incorporated herein by reference.

BACKGROUND OF THE INVENTION

1. Field of the Invention

The present invention relates to coatings as more particularly to coatings formed from zinc dialkyldithiophosphate derivatives.

2. Description of the Related Art

Surface coatings are of great importance in modern technology. The number of surface coatings applications is considerable and the demands on surface coatings continues to rise. In tribological applications, coatings are used to control friction and wear. The engine oil additive, zinc dialkyldithiophosphate (ZDDP), has been used in engine oil formulations for over 50 years due to its antiwear and antioxidant properties. ZDDP functions as an antiwear agent by forming a protective film or coating at the surfaces in sliding contact. These antiwear or tribochemical (or otherwise known as tribological) films protect the metal surfaces from excessive wear.

The present invention recognizes new applications of these ZDDP materials.

It is an object of the present invention to provide a novel coating technique.

It is another object of the present invention to provide a film formed from a ZDDP derivative material on a substrate.

SUMMARY OF THE INVENTION

Briefly stated, the invention involves a method of forming an annealed film of ZDDP derivative material on a substrate, comprising the steps of:

selecting a substrate which is reactive with ZDDP;

exposing said substrate to said atmosphere containing ZDDP for a sufficient period of time and at a sufficient temperature, so as to cause said ZDDP to thermally decompose to form a film on said substrate; and annealing said film.

In another of its aspects, the invention provides a method of coating a substrate with a zinc dialkyldithiophosphate (ZDDP) material, comprising the steps of:

selecting a substrate which is reactive with the ZDDP material;

providing an atmosphere containing the ZDDP material at a predetermined concentration; and exposing the substrate to the atmosphere for a sufficient period of time and at a sufficient temperature, so as to cause the ZDDP material to form a layered substrate having a layer of a ZDDP derivative material thereon; and annealing the layered substrate.

In another of its aspects, the invention provides a substrate having a ZDDP derivative material coated thereon according to the method as defined herein above.

In still another of its aspects, the invention provides a coated material comprising a substrate having gold constituent and a surface having a ZDDP derivative material coated thereon.

In yet another aspect of the present invention, there is provided a substrate with an annealed film of ZDDP derivative material thereon.

In yet another of its aspects, there is provided a method of forming an annealed film of ZDDP derivative material on a substrate, comprising the steps of:

selecting a substrate which is reactive with ZDDP;

exposing said substrate to an oil solution containing ZDDP for a sufficient period of time and at a sufficient temperature, so as to cause said ZDDP to thermally decompose to form a film on said substrate; and annealing said film.

In one embodiment, the oil solution includes an antioxidant.

The antioxidant, in this case, may be an aminic or a phenolic antioxidant and may, if desired, be selected from the group consisting of:

a bisphenol antioxidant or 2,5-dimercapto-1,3,4-thiadiazole derivative;

antioxidant compositions having (A) at least one secondary diarylamine, (B) at least one sulfurized olefin and/or sulfurized hindered phenol;

a phenol ashless antioxidant; or a thiadiazole compound.

BRIEF DESCRIPTION OF THE DRAWINGS

Several preferred embodiments of the present invention will now be described, by way of example only, with reference to the appended drawings in which:

FIGS. 13*a*, 13*b*, 13*c*, 13*d* are views of scanning electron micrographs (SEM's) of a selected thermal film subjected to humidity testing;

DESCRIPTION OF THE PREFERRED EMBODIMENTS

Figure 1A:
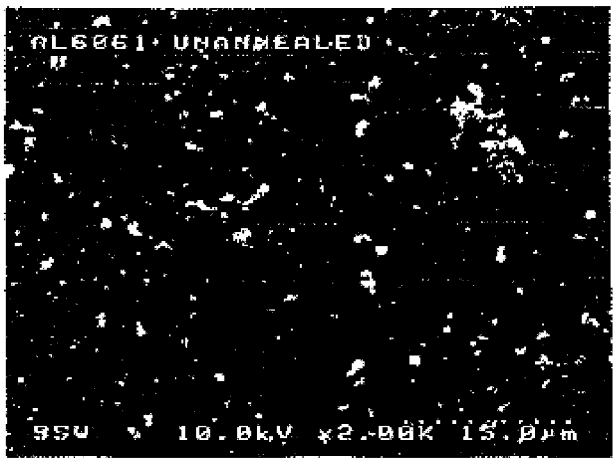
FIGS. 1*a*, 1*b* and 1*c* are views of scanning electron micrographs (SEM's) of selected thermal films.

When present in an engine lubricating oil, ZDDP decomposes at the rubbing surfaces of the so-lubricated engine components to form a polyphosphate film. X-ray absorption near edge structure (XANES) analysis of the surface and bulk of these ZDDP derived tribochemical films has revealed a layered film structure. Further analysis indicates that the surface is characterized by adsorbed ZDDP molecules along with long chain polyphosphates, while the bulk of the film is characterized by short chain polyphosphates.

ZDDP materials (the formula for which is generally shown at 'A') are commercially available for example from Imperial Oil (Esso) of Canada under product number ECA6654 and from Exon under the trade name PARANOX and come in a range of forms with alkyl groups having one to 10 carbon chains. Among others, such ZDDP materials include the 'primary' form in which the primary carbon of the alkyl chain or group is bonded to oxygen and the 'secondary' form in which the secondary carbon of the alkyl chain or group is bonded to oxygen. These different ZDDP materials have different characteristics including the temperature at which they decompose (the 'decomposition temperature'). For example, selected primary ZDDP materials will thermally decompose at temperatures of 180 degrees Celsius and up, whereas 'secondary' ZDDP materials have been shown to thermally decompose in the range of about 140 to 160 degrees Celsius.

A mechanism to explain these observations is believed to include the presence of a linkage isomer ZDDP ($Zn[O_2P(SR)_2]_2$), shown by formula 'B' as an intermediate which is illustrated in the following equations:

$$Zn[(RO)_2PS_2]_2(\text{solution}) \rightarrow Zn[O_2P(SR)_2]_2(\text{LI-ZDDP in solution}) \quad [1.1]$$

$$Zn[(RO)_2PS_2]_2(\text{solution}) \rightarrow Zn[(RO)_2PS_2]_2(\text{ZDDP adsorbed}) \quad [1.2a]$$

$$Zn[O_2P\ (SR)_2]_2(\text{solution}) \rightarrow Zn[O_2P(SR)_2]_2(\text{LI-ZDDP adsorbed}) \quad [1.2b]$$

$$Zn[(RO)_2PS_2]_2 \text{ or } Zn[O_2P\ (SR)_2]_2\ (\text{adsorbed}) + O_2(\text{or ROOH}) \rightarrow Zn(PO_3)_2(\text{polyphosphate}) + \text{sulphur species} \quad [1.3]$$

$$Zn(PO_3)_2 + 6H_2O \rightarrow Zn_7(P_5O_{16})_2 + 4H_3PO_4 \quad [1.4a]$$

$$Zn(PO_3)_2 + 3H_2O \rightarrow Zn_2P_2O_7 + 2H_3PO_4 \quad [1.4b]$$

$$Zn[(RO)_2PS_2]_2 \text{ or } Zn[O_2P(SR)_2]_2(\text{adsorbed}) + O_2(\text{or ROOH}) \rightarrow Zn(PSO_2)_2 + \text{sulphur species} \quad [1.5]$$

The mechanism can be explained as follows. It is believed that a portion of the ZDDP in solution undergoes an isomeric transformation resulting in the zinc groups being bonded to oxygen rather than to sulfur, to form what is referred to as a linkage isomer ZDDP (LI-ZDDP) and shown in equation 1.1. At the same time, it is believed that a portion of the ZDDP is physically adsorbed on the surface with no change in its chemical structure, as shown by equation 1.2a. It is further believed that the linkage ZDDP also becomes physically adsorbed on the surface, as shown by equation 1.2b.

It is at this stage in the mechanism that both the ZDDP and LI-ZDDP are believed to decompose to a zinc polyphosphate with the sulfur being lost to solution as shown by equation 1.3. Finally, it is believed that the zinc polyphosphate in the film undergoes a number of reactions with water present in the oil, for example to a medium chain zinc polyphosphate as shown by equation 1.4a, or zinc pyrophosphate as shown by equation 1.4b.

A particular feature of the present process is the decomposition of the ZDDP as laid out above in order to form the thermal films. This decomposition is believed to include the linkage isomer ZDDP. A similar mechanism for thermal film generation is believed to occur.

Equation 1.5 above illustrates what is believed to occur in the formation of a film on non-oxidizing surfaces, such as gold and platinum, as well as silver and the other platinum group metals. In the latter case, however, the sulfur present in the film may in some cases bind with the silver causing an unattractive appearance, though the mechanical integrity should be reasonably good. In this case, it can be seen that not all of the sulfur groups are lost to solution but rather are retained in the zinc thiophosphate. It is further believed that the presence of the sulfur in this complex gives rise to covalent bonds between the sulfur and selected sites on the surface, such as gold in the case of substantially pure gold. This covalent bond is believed to be sufficient to provide a suitable adhesion between the film and the substrate. For example, a Au—S bond is much stronger than a Au—O bond.

It should be pointed out that there may be some conditions in which such thermal films will not be successfully made. For example, in selected tests using the commercially available ZDDP compound described herein below, films were not formed when the substrate was exposed to a ZDDP containing oil at temperatures below 150 degrees Celsius. In other selected tests, films could be formed at 200 degrees Celsius during the first hour of heating. However, at this temperature the decomposition of ZDDP is very rapid and no ZDDP is left in solution after 1 hour. It is likely that attempts to form films using temperatures which exceed 200 degrees Celsius will cause both the ZDDP and some commercially available oils, such as those used in the Examples hereinbelow, to degrade too quickly to be useful. However, other solutions may be able to withstand these temperatures in some cases. 1 This suggests that care should be taken to provide sufficient, but not excessive, heat during the film forming stage. However, this will depend to a large extent on the type of ZDDP material used, the oil in which it is carried, the nature of the substrate and the temperature and duration of the film forming step. For example, those ZDDP materials known as 'primary' or 'aryl' are characterized by a higher temperature at which they thermally decompose.

The temperature at which the thermal film is formed (the 'thermal film forming temperature') should be selected according to a number of factors, the more important of which is the thermal decomposition temperature of the ZDDP compound being used. For example, if the 'secondary' ZDDP material is used, then the temperature at which the film is formed should be selected given the thermal decomposition temperature of the secondary ZDDP material, which may be in the region of 150 degrees Celsius. It is advisable to maintain the film forming temperature to within, say, 25 percent of the thermal decomposition temperature, although there may be instances where the film may be successfully formed at temperatures within say, 25 to 35 percent of the thermal decomposition temperature.

As will be described herein below, there is provided a method of coating a substrate with a zinc dialkyldithiophosphate (ZDDP) derivative material, comprising the steps of:

selecting a substrate which is reactive with the ZDDP material;

providing an atmosphere, preferably heated petroleum oil, containing the ZDDP material at a predetermined concentration; and exposing the substrate to the atmosphere for a sufficient period of time and at a sufficient temperature, so as to cause the ZDDP material to react with the substrate and to form a coating thereon.

In this case, the ZDDP material reacts with the substrate by a covalent bond of the O of phosphate for elements such as Al and Fe, and with the S of thiophosphate for elements such as Au.

Preferably, the atmosphere is a hot oil bath but could also be other liquids which dissolve ZDDP and are capable of withstanding other relatively high temperatures involved.

The term 'thermal film' used herein is intended to mean a film or coating produced by the exposure of a substrate in a thermal film-forming atmosphere as described herein above, as opposed to a film formed in a tribological environment, as is present in functioning oil-lubricated engines for example.

The term 'ZDDP derivative material' is intended to mean a material formed as a result of the ZDDP decomposing on the surface of the substrate and including, for example, polyphosphate or orthophosphate chains along with a zinc bearing group, such as, for example, $R_1ZnP_2O_7$, $R_2Zn(PO_4)_2$, or $R_3(PSO_2)_2$, where $R_1$, $R_2$ and $R_3$ may include a $C_1$ to $C_{10}$ alkyl group.

Preferably, the ZDDP material in solution is of the 'secondary' form and has a concentration, by weight, ranging from 0.5 to 5 percent, more preferably 1 to 2 percent and still more preferably 1.2 to 1.5 percent.

Preferably, the method includes the step of annealing the coated substrate in a heated atmosphere at a temperature ranging from 100 to 500 degrees Celsius. More preferably, the temperature ranges from about 120 to 400 degrees Celsius. Still more preferably, the temperature ranges from 150 to 300 degrees Celsius. Preferably, the annealing step occurs in an atmosphere including oxygen, such as common air, so as to oxidize the layer, thereby to liberate at least some of the unreacted ZDDP.

Preferably, the annealing step occurs for a duration of 1 to 4 hours. The temperature and duration of the annealing step is selected according to the nature of the substrate and the nature of the layer desired. For example, the thickness of the layer is related to the immersion time and the extent of the decomposition of ZDDP in solution. Similarly, the length of the polyphosphate chains, a principle feature of such films, will tend to decrease in length with increasing annealing temperature, due to the liberation of sulfur and the reaction of the sulfur groups in the chain with reactive sites on the substrate.

The present method can be applied to a number of substrate materials including steels, aluminum (and alloys of both) and noble metals such as gold, the latter in substantially pure or alloyed forms. What is particularly exciting is the discovery that the present technique can be used to form a mechanically stable protective coating on substantially non-oxide forming substrates as is typically the case with a gold bearing substrate for example. In selected experiments using substantially pure gold leaf substrate, though there were no oxidation products to be found on the substrate surface to establish a suitable coating bond. It is believed that a gold-sulfur bond was nonetheless formed between the layer and the substrate, yielding a coating with significant mechanical integrity.

The method can be applied in a number of different ways to yield a coating having a range of properties, such as thickness, hardness and adhesion strength. For example, in the case of steel, the layer preferably has a thickness of 100 to 2500 Angstroms, still more preferably from 300 to 700 Angstroms, for example about 500 Angstroms. It is further believed that coatings can be made on steel and other substrates, such as those with a noble metal constituent, with a thickness ranging from 50 Angstroms to 10 microns, the higher range of thicknesses being achieved by increasing the film forming temperature or by increasing the duration of the film forming step or both. Hardness will depend to some extent on the hardness of the substrate on which the coating is formed. For example, the hardness of a coating made herein may have a hardness ranging from about 50 percent to about 100 percent of the hardness of the substrate, wherein the higher of this ranges would typically be possible on softer substrates. On steel, for example, coatings may have a hardness ranging from 55 to 90 percent of the hardness of the steel substrate. On gold alloys and aluminum substrates, this range may be higher. The adhesion strength of the film can be measured in a number of ways, though a preferred method is that used in the Examples herein below involving the use of a Rockwell 'C' hardness tester, which is drawn over the coated substrate. Using this standard, coatings made herein have been shown to withstand loads from 1 to 6 kilograms. In the Examples to follow, it is shown that these loads cause scratch channels of depths ranging 1 to 4 microns within the substrate itself. Even so, subsequent spectral analysis, for example at 5 kilogram loadings, demonstrated that the films were nonetheless intact.

In the case of aluminum, the layer has a thickness ranging from about 50 to 2500 Angstroms, more preferably 100 to 1500 Angstroms, still more preferably 125 to 1000, still more preferably, 150 to 750 Angstroms, still more preferably, 350 to 550 Angstroms.

Another particular feature of annealed films produced by the present process is their increase in hardness over the non-annealed films. It is further believed that the hardness of the film increases with annealing temperature. Such hardened films should enhance the benefits of such films where increased hardness is an asset.

The films prepared by the present process are believed to be formed predominantly by phosphate chains, whose phosphate building blocks are known to be soluble in different solutions. Testing of films made by the present process in deionized water and salt brine solutions revealed that these films are vulnerable, in some cases, to dissolution. Therefore, the use of such films in environments such as this may not provide satisfactory results in some cases.

Thus, the method herein provides a substrate having a ZDDP derivative material coated thereon.

In addition, the method herein forms a coated material comprising a substrate having a noble metal constituent, such as gold and platinum and a surface having a ZDDP derivative material coating formed thereon. Preferably, the coating includes a sulfur constituent, the coating being attached to the substrate by a bond between the gold and sulfur constituents, although the sulfur is also believed to be capable of bonding with platinum as well.

On selected test samples, annealed films were shown to withstand significant scratch resistance over their unannealed counterpart. In addition, selected samples were tested by 'wiping' with a cloth and a chemical cleaner with the annealed films showing substantially improved resistance over their unannealed counterpart.

In yet another of its aspects, there is provided a method of forming an annealed film of ZDDP derivative material on a substrate, comprising the steps of:

selecting a substrate which is reactive with ZDDP;

exposing said substrate to an oil solution containing ZDDP for a sufficient period of time and at a sufficient temperature, so as to cause said ZDDP to thermally decompose to form a film on said substrate; and annealing said film.

In one embodiment, the oil solution includes an antioxidant, which can in some cases result in reduced film formation times. This is due to the fact that the antioxidant protects the oil from oxidation (degradation) so that the temperature of the oil environment. oil environment may be increased to relatively high temperatures (for example up to about 250 degrees Celsius), so that the film is formed at a greater rate. As will be seen in selected Examples herein below, the formation rates were sufficiently high that films were formed in as little as 4 hours.

Without such antioxidants the oil, in many cases, would not withstand these relatively high temperatures. Consequently, such degradation would be extended to have an impact on the formation of the film and its resulting characteristics. There may, however, be other oils that have improved heat resistance without the need of antioxidants. It is not intended to limit the scope of the invention, necessarily, only to those oils containing antioxidants at these operating temperatures. Moreover, there may be some instances where such oil degradation may be beneficial. This might occur, in the form of a colour change wherein the other characteristics of the film, such as hardness or ductility have not been otherwise comprised for its intended use.

Embodiments of the present invention will be described with reference to the following examples which are presented for illustrative purposes only and are not intended to limit the scope of the invention.

EXAMPLES

Formation of Thermal Films

Materials

A commercial 'secondary' ZDDP concentrate, including 85% secondary (Carbon-4) and 15% (Carbon-8), was obtained from Imperial Oil (Esso) of Canada under product number ECA6654. A base petroleum oil, known by the trade name MCT 10, was also obtained from Imperial Oil of Canada. Oil solutions were prepared by mixing 1.2 wt % of the commercial ZDDP concentrate in MCT-10 base oil by stirring at 50–60° C. for ~15 minutes. Testing of this ZDDP material has shown thermal decomposition occurring in the neighbourhood of 150 degrees Celsius.

Thermal films were prepared on steel, aluminum and gold. Hardened A2 tool steel (C, 1%; Mo, 1% and Cr, 5%) was obtained from Imperial Oil of Canada. A sample of substantially pure gold, obtained commercially, was cleaned prior to use by immersion in a 5% $HNO_3$ solution, followed by rinsing in de-ionized water, methanol and then n-hexane. The A2 steel and aluminum alloy were cut into coupons with dimensions of ~9×9×3 mm. The cut A2 steel and aluminum alloy coupons were then polished with 320 G, followed by 600 G alumina paper wetted with distilled water.

Thermal films were prepared by suspending the metal coupons in an erlenmeyer flask containing the heated ZDDP oil solution for the desired length of time, at temperatures between 150° C. and 200° C. The desired length of time depends on the thickness of film desired, that is up to a current maximum of 2500 using the current technique. For a film of 500 A, a time of approximately 3 hours would be used and for a film thickness in the vicinity of 2500 A, a time of approximately 24 hours would be used. The erlenmeyer flask was heated in a constant temperature oil bath (±2° C.). Excess oil was blotted from the surface of the coupons very gently with a tissue paper. Then each coupon was rinsed with n-hexane soon thereafter to remove any additional oil.

Wear tests were performed on each coupon in a Plint High Frequency Wear Tester at the Imperial Oil Research Centre. This machine reciprocates a cylindrical pin against the flat coupon. The metal coupons and cylindrical pins were cleaned in an ultrasonic bath using a light hydrocarbon solvent prior to the test, and then placed in the Plint reciprocating wear tester. The cylindrical pin, identical in composition to the metal coupon being used, was loaded against the coupon in the test oil solution at a load of 220N. The speed of the cylinder against the coupon was increased slowly to 25.0 Hz and then maintained for the required length of time. After the test, the excess oil was gently blotted from the surface with a tissue paper.

Data Acquisition and Analysis

Phosphorus and sulphur K and L-edge X-ray absorption spectra were obtained at the 1 GeV Aladdin storage ring, University of Wisconsin, Madison. The K-edge spectra were obtained on the Double Crystal Monochromator (DCM) beamline, covering the photon region of 1500–4000 eV. The Grasshopper beamline was used to obtain the L-edge spectra, in which the X-ray beam is monochromatized by an 1800 g/mm grating and covers the photon region of 70–900 eV. The photon resolution at the P L-edge and P K-edge were <0.2 and <0.8 eV, respectively.

The photoabsorption spectra were recorded in the total electron yield (TEY) and fluorescence yield (FY) modes. The maximum analysis depths are known to be ~50 Å for TEY at the L-edge, ~500 Å for FY at the L-edge and TEY at the K-edge, and calculated to be >10 $\mu$m for FY at the K-edge. For the L-edge spectra a single scan, with good signal-to-noise ratio could be accomplished in ~5 minutes. However, in most cases at least three scans were digitally combined and after normalization, a background was removed.

Annealing of Thermal Films on Steel, Aluminum and Gold

Figure 1B:
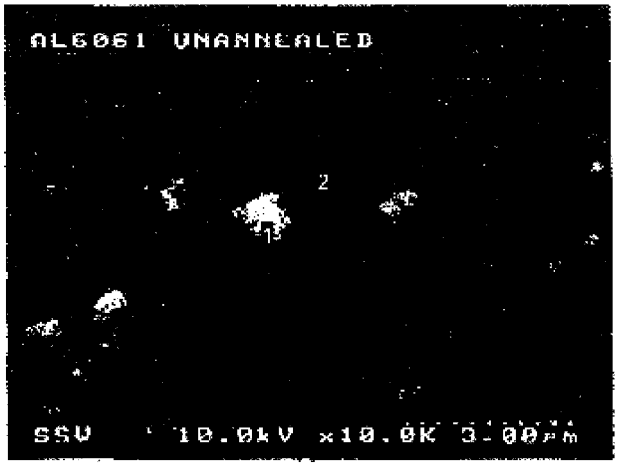
Figure 1C:
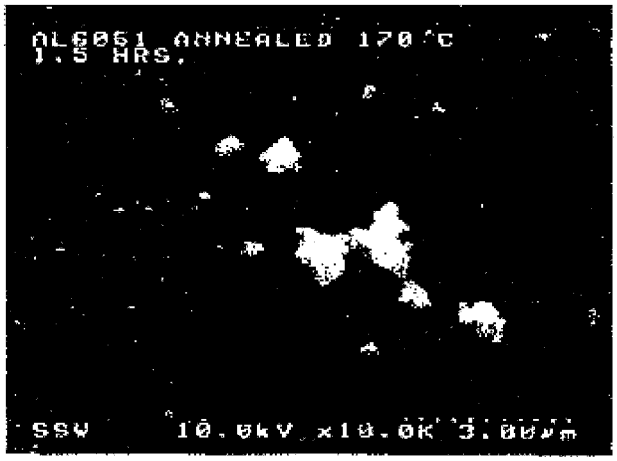

Thermal films were prepared on steel, Al alloy and pure gold by immersing the metal coupons into heated ZDDP oil solutions. After preparation, the thermal films were rinsed well with n-hexane and then annealed in a furnace. In order to determine whether annealing has an effect on the thermal film structure or appearance, scanning electron micrographs (SEM's) were taken of annealed thermal films on Al alloy, before and after annealing. Scanning electron micrographs (SEM) of these phosphate thermal films on an Al alloy are shown in FIGS. 1(*a–c*). A lower magnification SEM of a thermal film is shown in FIG. 1*a*. Some large phosphate particles have also been deposited on the film surface during film generation. Higher magnification SEM's of a thermal film before (b) and after (c) annealing are also shown. The film is composed of spherical balls, approximately 0.3 microns in size, covering the metal surface. The SEM photo of the annealed film (c) looks very similar to that of the film before annealing (b), indicating that the film structure does not appear to change with annealing. Rather, annealing is believed to change the film by decreasing the content of sulphides in the film by increase the number of metal-sulphur bonds between the film and the substrate.

XANES results of thermal films generated from ZDDP on A2 steel, Al alloy and pure gold, before and after annealing will be presented in the following sections. Results of various mechanical and chemical treatments applied to the annealed thermal films, in order to assess their stability, will also be discussed.

P and S L-edge XANES Spectra of Annealed Thermal Films on A2 Steel

A batch of thermal films on A2 steel was prepared by immersing the steel coupons in a ZDDP oil solution heated at 150° C. The ZDDP oil solution had already been heated 1–2 hours at 150° C. before the immersion of the coupons. The coupons were removed from the ZDDP oil solution after 6 hours. Prior to annealing, the thermal films were rinsed with n-hexane to remove residual oil. Thermal films were annealed at 150° C., 200° C. and 300° C. for 1 hour.

Figure 2:
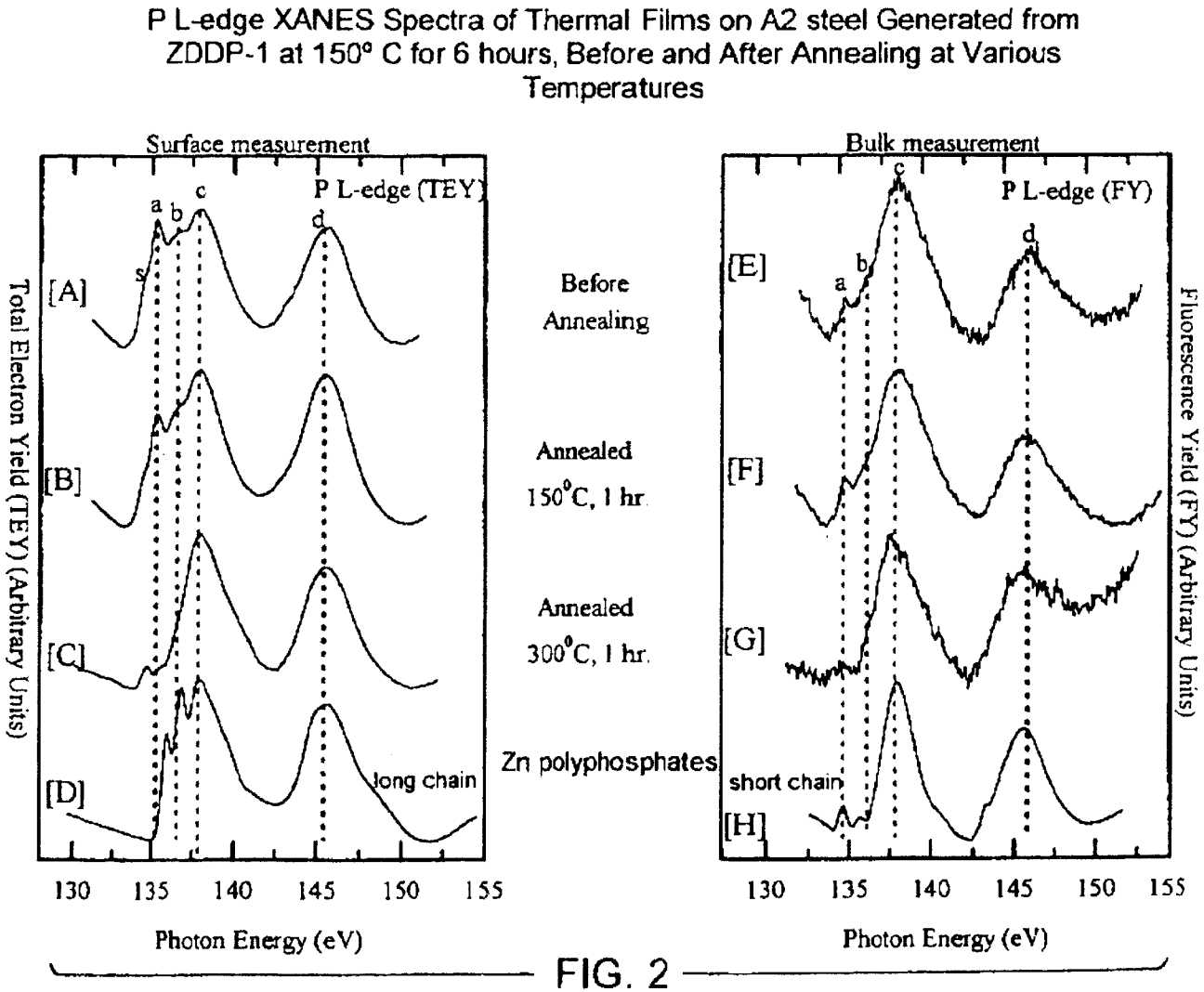
FIG. 2 is a plot showing XANES spectra for selected thermal films.

FIG. 2 shows the P L-edge XANES TEY (surface) and FY (bulk) spectra of the films before and after annealing at the specified temperatures. The surface (TEY) and bulk (FY) spectra of the thermal film before annealing, in FIG. 2 ([A] and [E]), reveal a layered film structure.

Polyphosphate chain length is known to increase with an increase in the intensity of peaks a and b, relative to peak c, and peak a is always less in intensity than peak b. This change in peak intensity is illustrated in FIG. 2 by comparing the P L-edge XANES spectra of the short [H] and the long [D] chain polyphosphate model compounds. Therefore, the average polyphosphate chain length of the surface of the film is characterized by long chain polyphosphate species (spectrum [A] compared to [D]), whereas the bulk of the film (spectrum [E] compared to [H]) is characterized by short chain polyphosphate species. Peak a in spectrum [A] is more intense than peak b indicating that another species is present on the film surface, along with the long chain Zn polyphosphate. This peak a can be attributed to the presence of LI-ZDDP, as described herein above. Comparison of the surface spectra ([B], [C]) of the annealed thermal films reveals a decrease in chain length with an increase in annealing temperature. This is seen by the progressively reducing peaks a and b. Also, the unreacted ZDDP is removed from the film in spectrum [C].

A similar trend is noted in the bulk spectra ([F], [G]), although the decrease in polyphosphate chain length is not as dramatic as in the surface spectra. This is primarily because the initial polyphosphate chain length in the thermal film before annealing, is already of the 'short chain' variety, as evidenced by the relatively small peaks a and b.

There is known to be a decrease in polyphosphate chain length in antiwear films rubbed further in base oil, that is with no ZDDP present. In contrast, the present process appears to cause a decrease in chain length with increasing annealing temperature and this is believed to be due to an intermolecular decomposition reaction yielding short chain polyphosphate.

Figure 3:
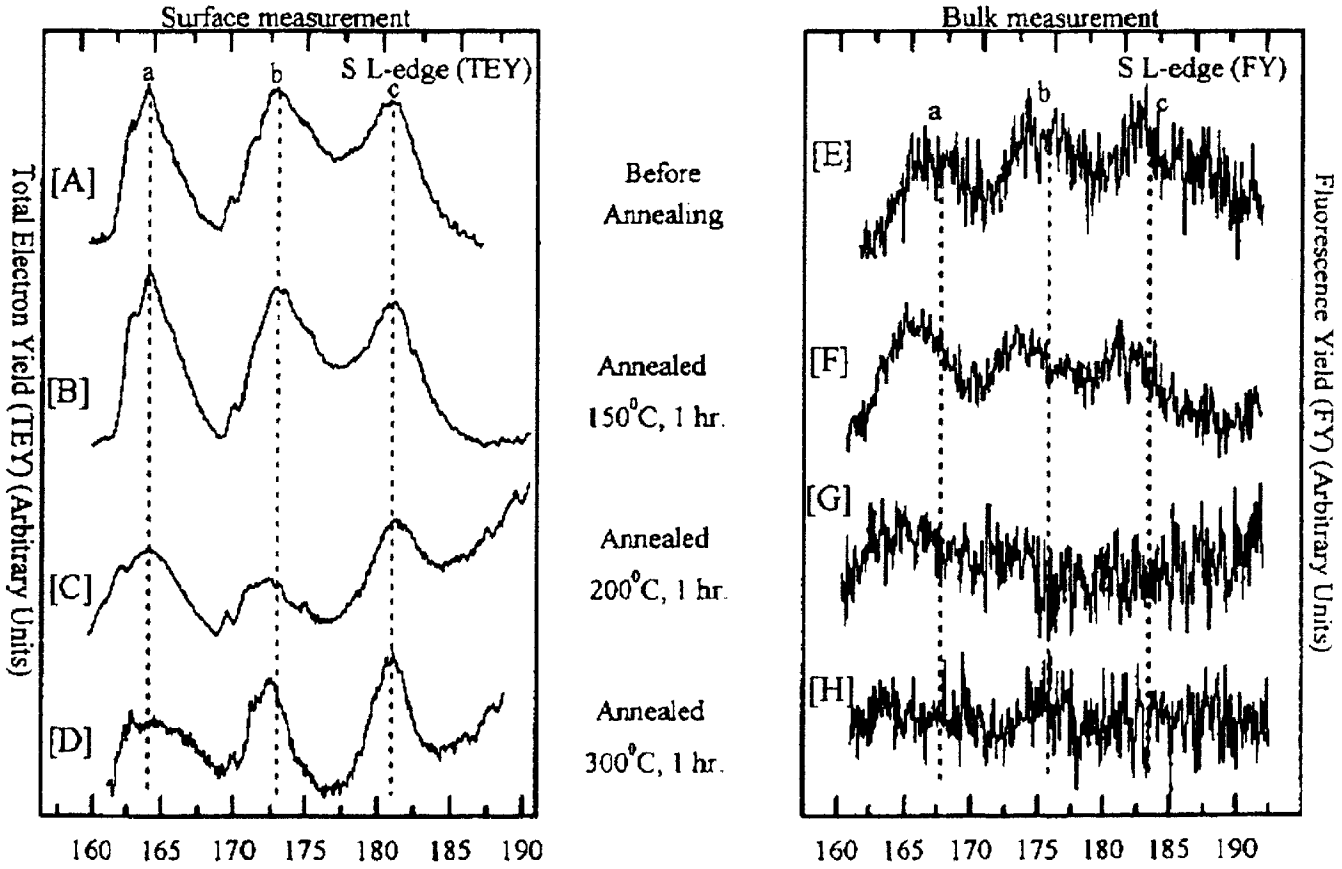
FIG. 3 is another plot showing XANES spectra for selected thermal films.

FIG. 3 shows the S L-edge TEY and FY XANES spectra of the same films presented in FIG. 2. The surface (TEY) spectrum of the thermal film before annealing (spectrum [A]) reveals the presence of S in the form of sulfide ($S^{2-}$) and sulphate ($SO_4^{2-}$). The FY spectra on the right in FIG. 3 show a significant level of 'noise' indicate that the film contains a small amount of sulphur in its 'bulk', that is in the body and inward from the surface thereof.

The utilization of element sensitive techniques such as EPMA (electron probe microanalysis) and XRF (X-ray fluorescence) in the investigation of the tribochemical films, has shown that the amount of S is reduced in the tribochemical films compared to ZDDP. This indicates that the ZDDP has decomposed in the formation of the tribochemical films. Previous S L-edge XANES studies of the tribochemical films have shown that the remaining S is in the reduced form ($S^{2-}$). S L-edge XANES studies of ZDDP derived thermal films reveal the presence of both the reduced ($S^{2-}$) and an oxidized form of S ($SO_4^{2-}$). It has been found that immersed blank steel coupons in heated base oil (with no ZDDP) produced $SO_4^{2-}$ film. Thus, the presence of $SO_4^{2-}$ in the film predominantly originates from the base oil.

Examination of the surface spectra of the annealed thermal films (spectra [B], [C] and [D]) shows the persistence of sulphate in the films although spectra [G] and [H] show that the amount of sulphate decreases on annealing. Also evident is the decrease in the amount of sulphide, with increasing annealing temperature. The decrease in sulphide is consistent with the decomposition of unreacted ZDDP (FIG. 2 [A], shoulder s) or linkage isomer ZDDP (FIG. 2 [A], peak a) present on the film surface (equation 1.3). Therefore, films formed by the present process are different from those formed by conventional tribological treatments in internal combustion engines.

Comparing thermal films to tribological films, an annealed thermal film made according to the present process will typically have more sulphates than a tribological film. After annealing there is typically only a trace amount of sulphides, whereas there is typically more sulphides in the tribological film. The sulphides are a reduced form of sulphur and are reactive.

Particle Induced X-ray Emission (PIXE) analysis of the 300° C. annealed thermal film yielded a film thickness of ~500 Å.

P L-edge XANES Spectra of Annealed Thermal Films on Aluminum and Gold

ZDDP decomposition in solution is known to have an effect on thermal and antiwear film chemistry on steel. Thus, care was taken to bring the oil bath temperature to the desired temperature before placing the ZDDP oil solution into the oil bath. The temperature of the ZDDP oil solution was then monitored, and as soon as its temperature reached the desired temperature (~10–15 minutes) the coupons were immersed in the ZDDP oil solution. A set of thermal films were then prepared on the aluminum alloy immersed in the ZDDP oil solution for 4, 5, 12 and 24 hours.

Figure 4:
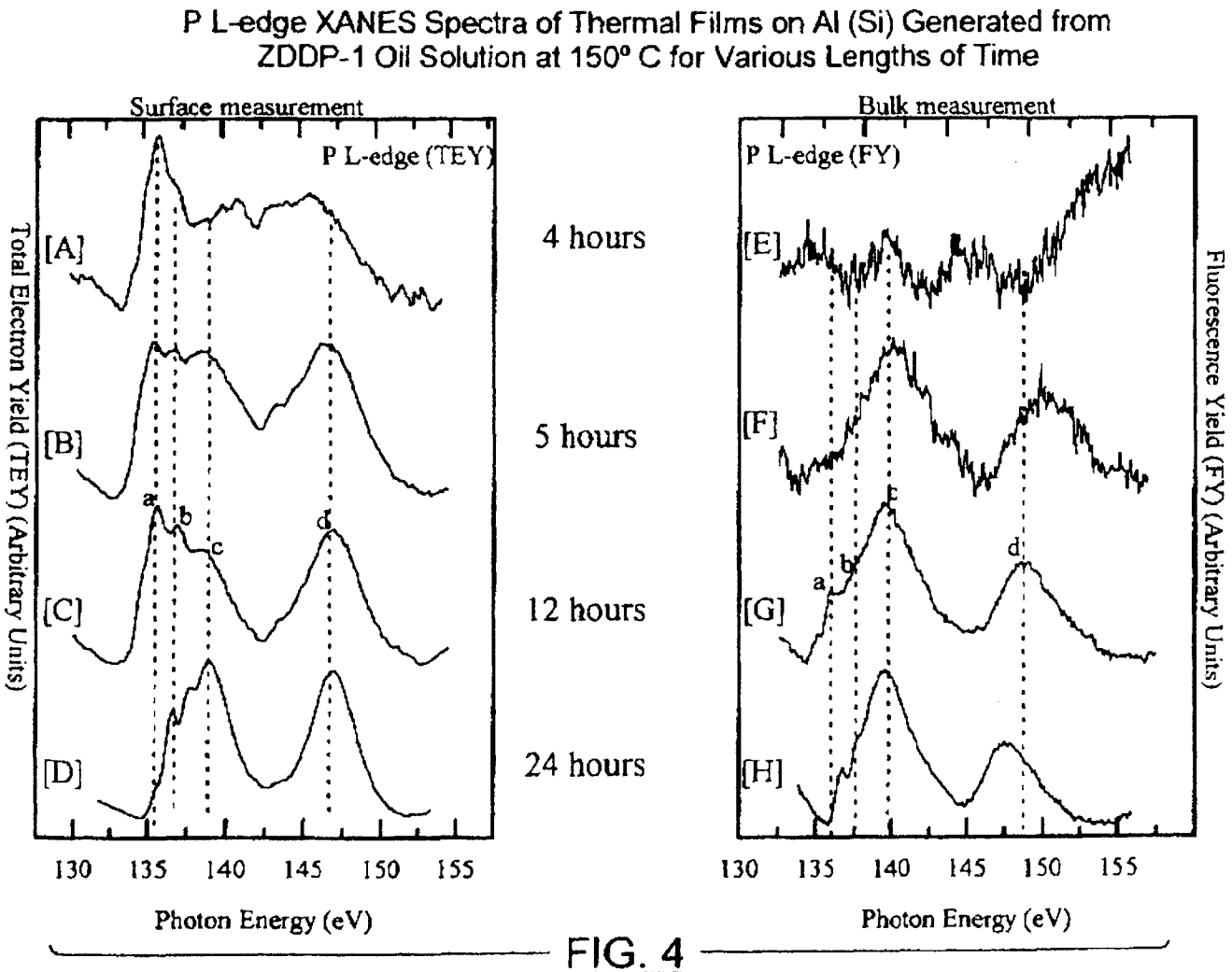
FIG. 4 is still another plot showing XANES spectra for selected thermal films.

The P L-edge TEY and FY XANES spectra of the thermal films on the aluminum alloy are presented in FIG. 4. The change in thermal film chemistry on aluminum, with ZDDP oil solution heating time, similar to what was observed in the study on steel, confirms that ZDDP decomposition in solution does indeed affect film chemistry. Intensity at peak position a in spectrum [C] indicates the presence of linkage isomer ZDDP on the film surface.

Figure 5:
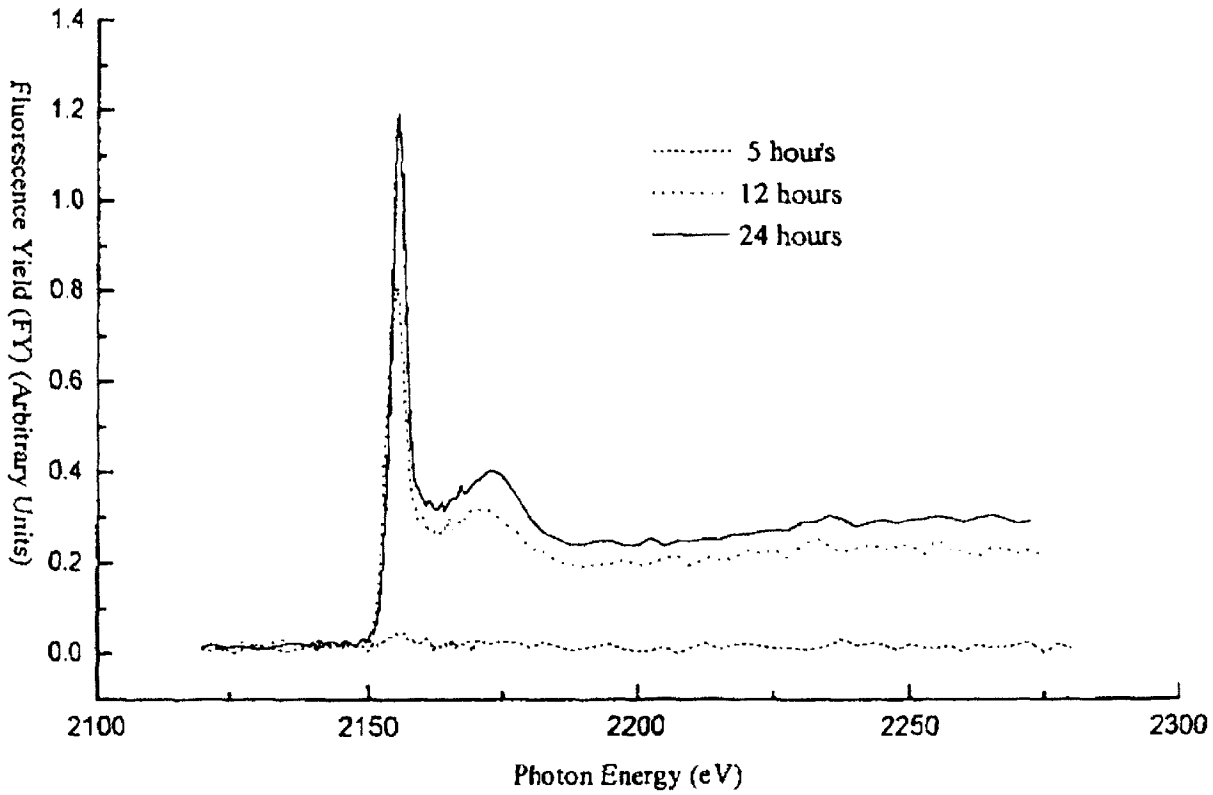
FIG. 5 is a plot showing Peak Height Increase for selected thermal films.

The FY spectra of the thermal films in FIG. 4 became less noisy as immersion time increases, indicating that the film became thicker, the longer it remained immersed in the heated ZDDP oil solution. FIG. 5 shows the P K-edge XANES spectra for the same thermal films described in FIG. 4. It can be seen that the peak height increases with increasing immersion time, indicating an increase in film thickness. Analysis of the thermal films using PIXE, reveals a film thickness of ~730 Å for the 12 hour film, and ~1040 Å for the 24 hour film.

Figure 6:
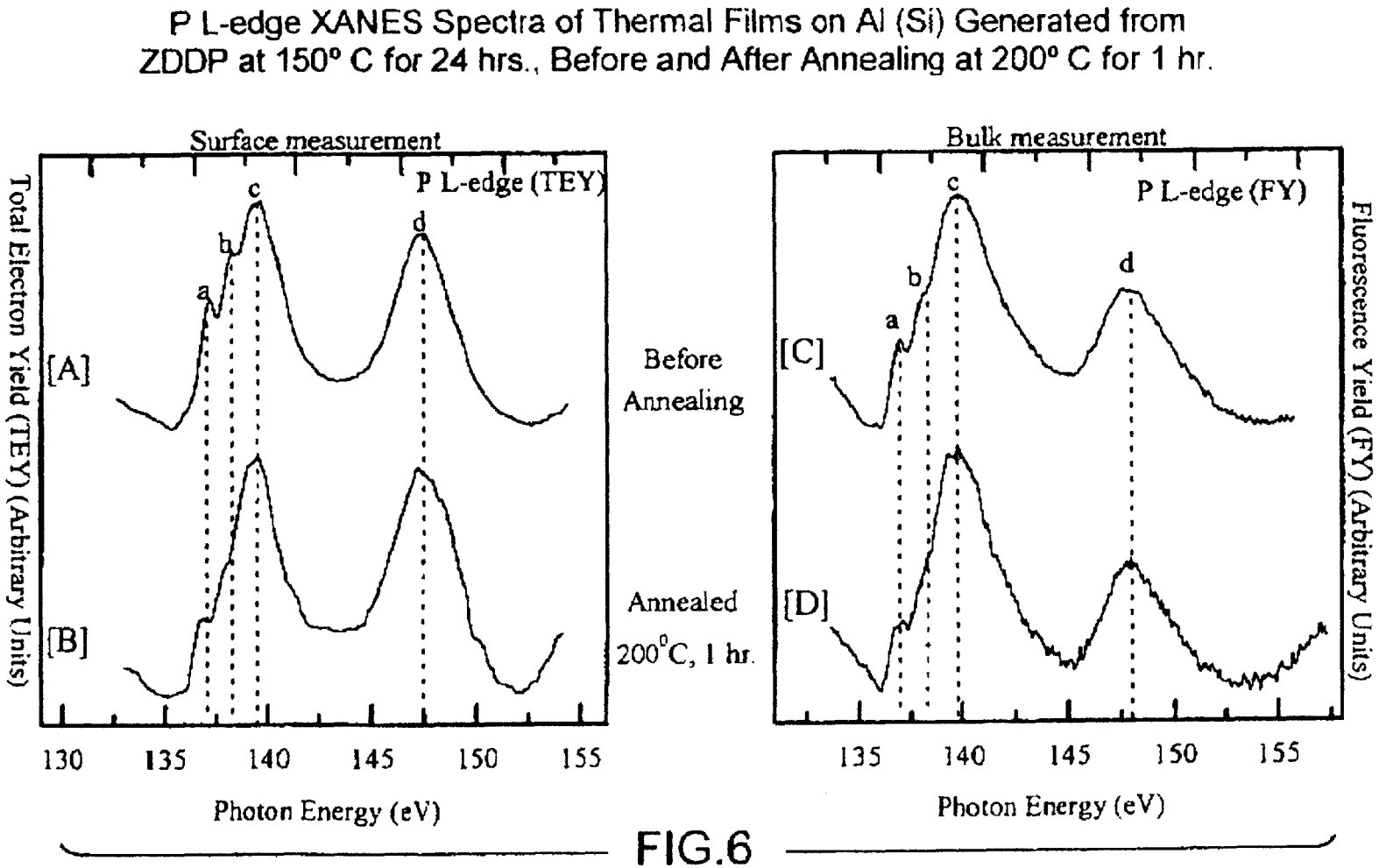
FIG. 6 is a plot showing XANES spectra for selected thermal films.

The 24 hour thermal films on the aluminum, generated from ZDDP at 150° C., were used for the annealing study. The films were annealed at 200 and 300° C., for 1 hour. The P L-edge XANES spectra of the thermal films before and after annealing at 200° C., are shown in FIG. 6. As with the thermal films on steel shown in FIG. 2, polyphosphate chain length decreases as a result of the annealing step. The thermal film on aluminum annealed at 300° C. is consistent with these results and is not shown in FIG. 6.

Figure 7:
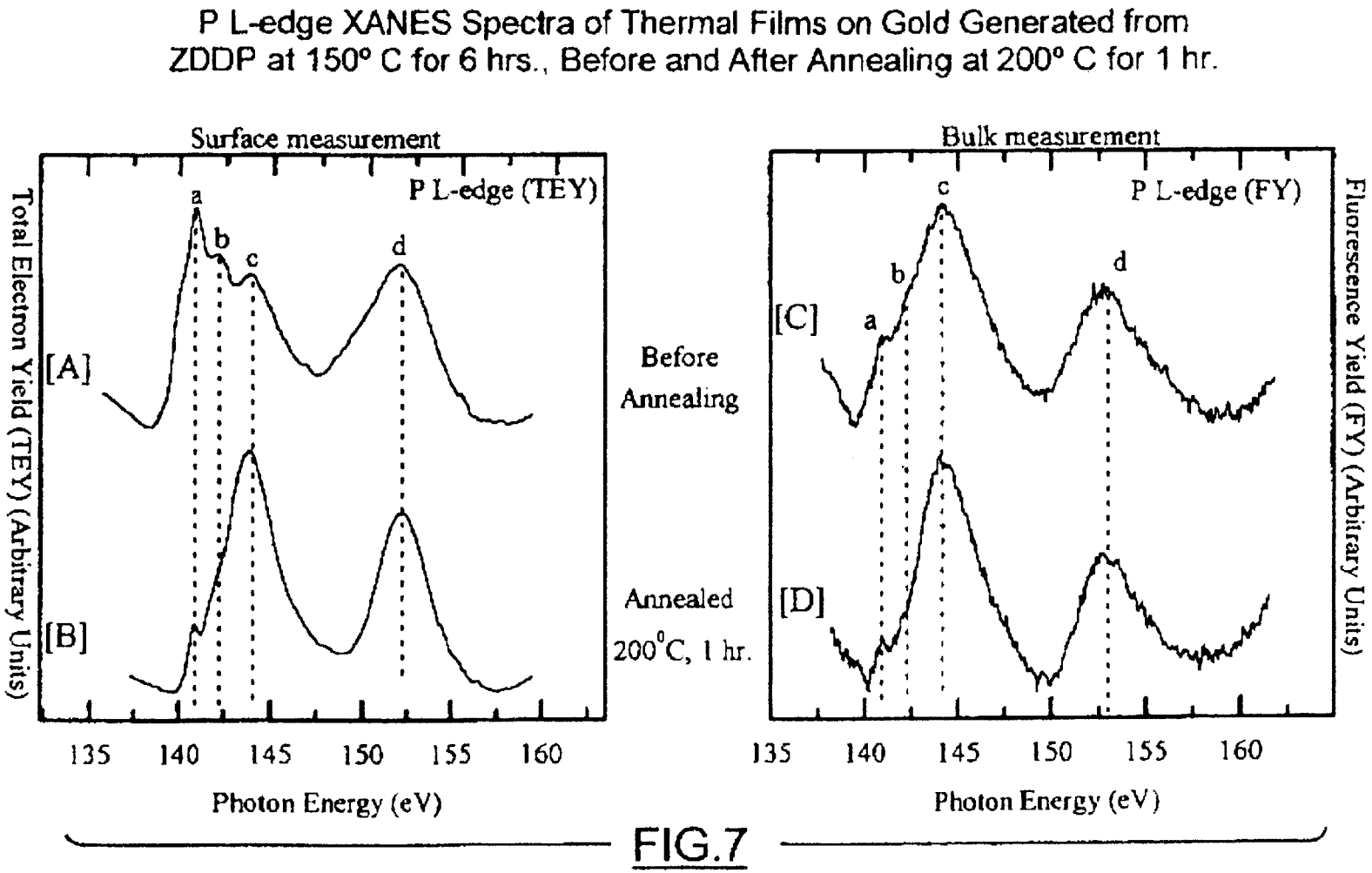
FIG. 7 is another plot showing XANES spectra for selected thermal films.

Thermal films generated from ZDDP, were also prepared on gold. The gold was immersed in the ZDDP oil solution heated at 150° C. for 6 hours. The P L-edge TEY and FY XANES spectra of the thermal films on gold, before and after annealing, are shown in FIG. 7. As is apparent from FIG. 7-C, though no metal oxide is present on gold, ZDDP forms a polyphosphate film. This is consistent with the mechanism as described herein above, as no metal ions are required to form long chain polyphosphate (see equation 1.3). However, the surface measurement (spectrum [A]) shows that peaks a and b are of unusually high intensity, relative to peak c. The high intensity of these peak may be attributed to the presence of a very thin (~50 Å) film of unreacted ZDDP or LI-ZDDP. FIG. 7 shows that after annealing, the intensity of peaks a and b drops (relative to peak c), and the spectrum resembles that of a short chain polyphosphate (spectrum [B]). The decomposition of ZDDP or the LI-ZDDP may not follow the mechanism discussed herein above and it is possible that the decomposition of ZDDP involves the formation of short polyphosphate compounds, accompanied by the loss of various volatile P compounds.

Mechanical and Chemical Treatment of Films

The annealed films on steel, aluminum alloy and gold were subjected to various mechanical and chemical treatments in order to assess their stability under these conditions.

Figure 8A:
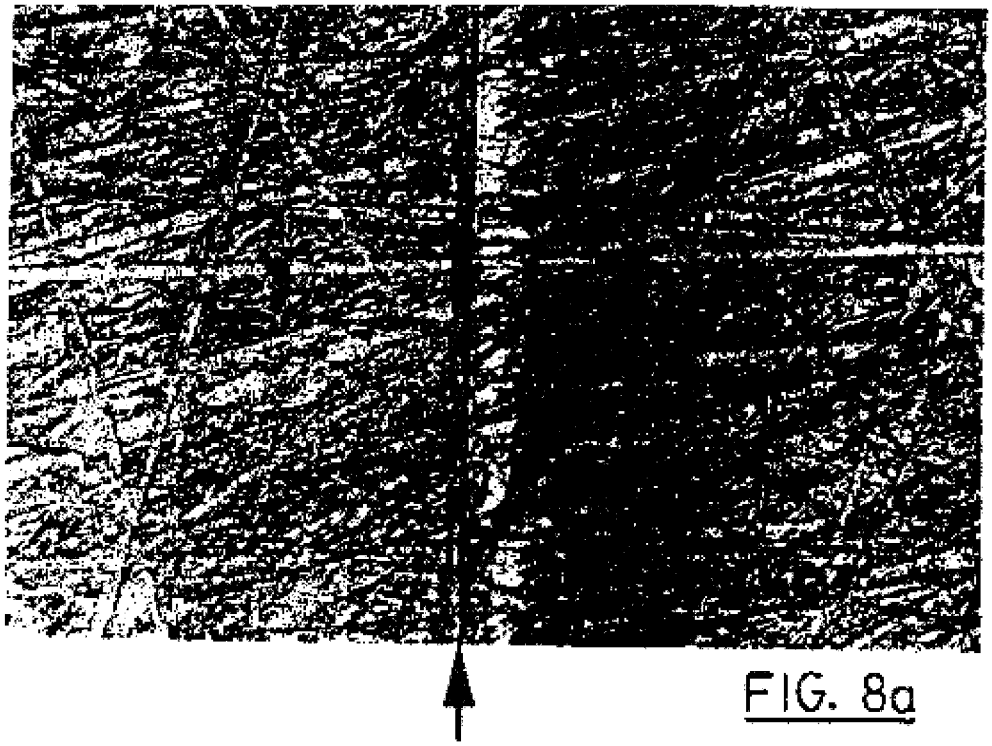
FIGS. 8*a* and 8*b* are views of two optical micrographs of selected thermal film samples.
Figure 8B:
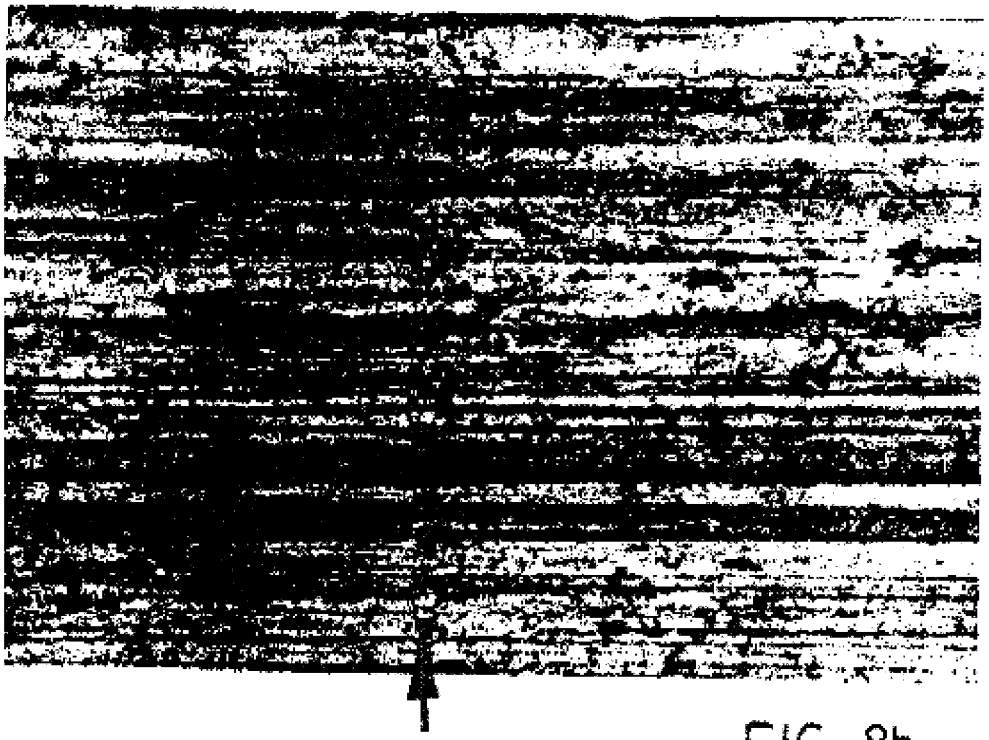

Mechanical Treatments of the Films on Steel: Scratch Test (a) Qualitative Scratch Test A qualitative scratch test was performed on the thermal film, both before and after annealing at 300° C. for 1 hour. The thermal film preparation is described in the earlier section. Particle Induced X-ray Emission (PIXE) analysis of the 300° C. annealed thermal film yielded a film thickness of ~500 Å. A razor blade was then drawn across the films while observing under an optical microscope. A picture was taken after the test and the resulting optical micrographs are shown in FIG. 8*a* thermal film before annealing and FIG. 8*b* after annealing at 300° C. for 1 hour. The polishing procedure is described in the experimental section. Before the scratch, the entire area of the sample was covered with the film. The vertical streak in the middle of (a) shows where the razor cut through the unannealed film, scraping film away from the metal surface. The blue-coloured annealed film in (b) again covers the entire metal surface. The razor was drawn across the annealed film with as much manual force as possible (not quantified). The film was only slightly indented as shown by the vertical streak in the middle of (b). Thus, the annealed thermal film is much more scratch resistant than its unannealed counterpart.

(b) Quantitative Scratch Test

Quantitative scratch testing was done on thermal films prepared on 52100 steel by immersion in a ZDDP oil solution heated at 150° C. for 24 hours. The thermal films were annealed at 250° C. for 1 hour. A scratch tester using a Rockwell "C" diamond indenter was used to determine the mechanical stability of the phosphate films on the steel substrate. Loads ranging from 1 to 6 kg's were applied during scratch testing. Typically, the load was increased in increments over a 1 kg range, along a 1 cm distance. The scratch channels were analyzed using optical and scanning electron microscopies (SEM), Auger spectroscopy and energy dispersive X-ray analysis (EDX). Results show that the film stays adhered to the steel substrate, even at a load of 6 kg.

Optical micrographs of an annealed phosphate film on steel, scratch tested at 1 and 5 kg loads as compared to blank steel are shown in FIG. 9. The direction of the scratch test is from left to right. FIGS. 9*a*) and *b*) of the scratch tested blank steel indicate that the steel itself is plastically deformed at these loads. Scratch channel widths of 40 and 90 μm at the 1 and 5 kg loads respectively, are indicated in FIGS. 9*a*) and *b*). Surface profilometry of the scratch channels yielded channel depths of <1 μm at a 1 kg load and approximately 4 μm at a 5 kg load.

Figure 9A:
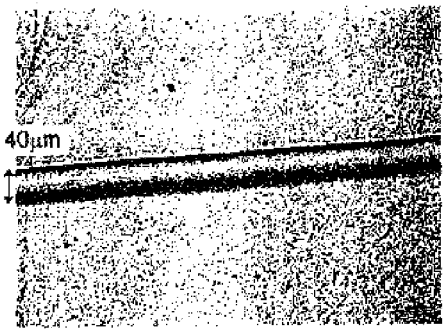
FIGS. 9*a*, 9*b*, 9*c* and 9*d* are views of several optical micrographs of selected thermal film samples following a scratch test.
Figure 9C:
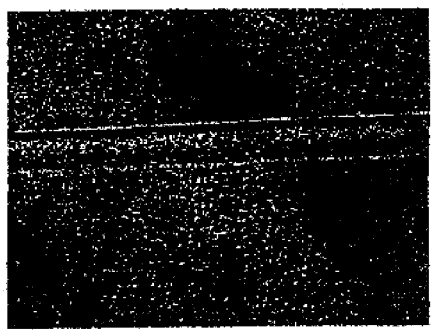
Figure 9B:
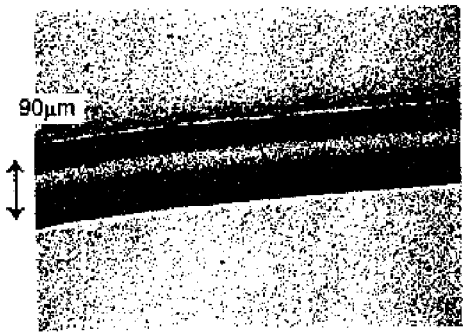
Figure 9D:
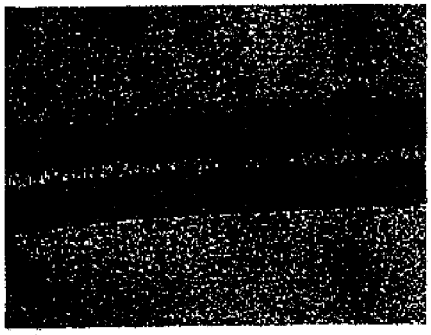
Figure 10A:
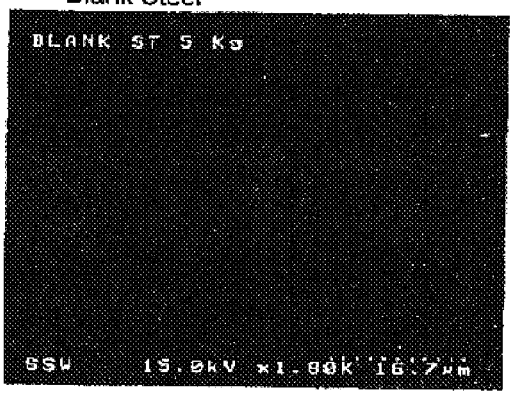
FIGS. 10*a*, 10*b*, 10*c* and 10*d* are views of scanning electron micrographs (SEM's) of selected thermal film samples following a scratch test.
Figure 10C:
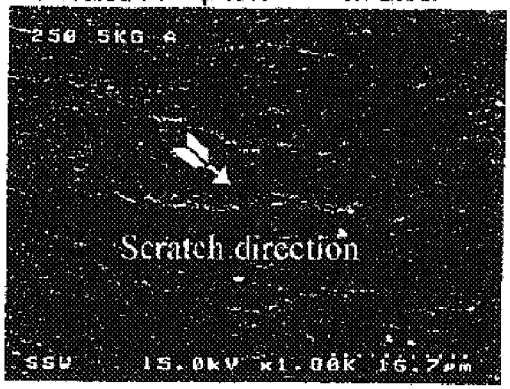
Figure 10B:
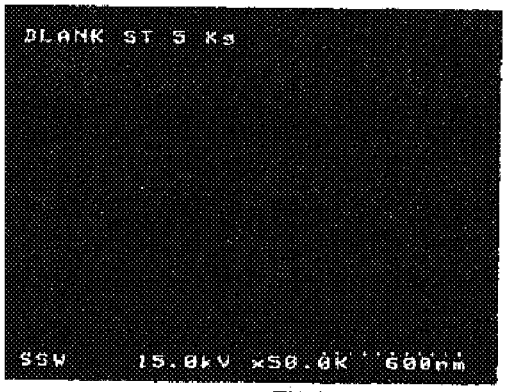
Figure 10D:
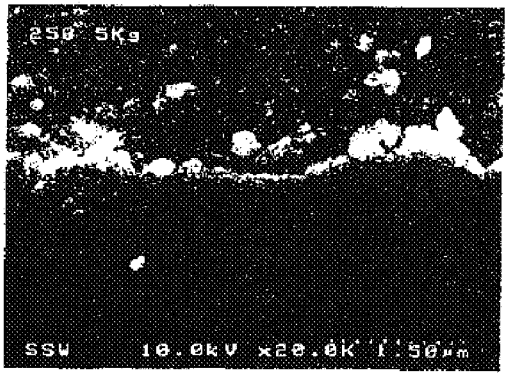

FIGS. 9*c*) and *d*) of the film on steel indicate that although the film is not able to prevent the plastic deformation of the steel, the film still adheres to the steel substrate at these loads. Dark semicircles propagating outward from the center line of the track are apparent in the scratch channel of the film tested at a 5 kg load (FIG. 9*d*). It is difficult to determine from the optical micrograph in d) whether the dark semicircles are due to cracks in the film, or ridges of film formed by the indenter plowing through the film during scratch testing.

However, scanning electron micrographs (SEM's) of these scratch tested areas do indicate that the semicircles are actually ridges of film. SEM's of the scratch channels on blank steel and annealed phosphate film, at a 5 kg load, at low (1800×) and high magnification (50 000×), are presented in FIG. 10. The scratch channels on the steel at low (a) and high (b) magnification on the blank steel are featureless. On the other hand, the SEM of the annealed film scratch channel at low magnification (d) reveals the presence of semicircular ridges of film. The higher magnification SEM (d) was taken at the edge of the scratch channel in order to compare the film structure before and after scratch testing. As the SEM (d) indicates, the film appearance is not preserved after scratch testing. The spherical balls seen at the top of the SEM, away from the scratch channel, are not apparent in the scratch channel (bottom half of the SEM).

Figure 11A:
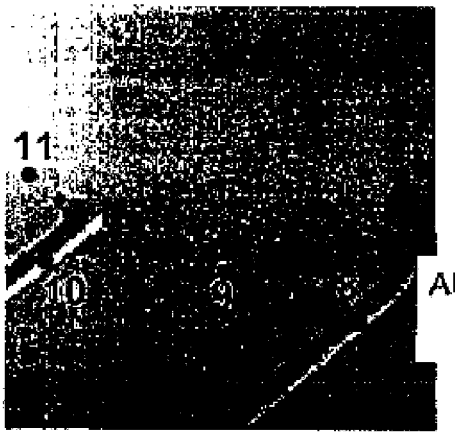
FIG. 11*a* is scanning electron micrograph as a reference for the following FIG. 11*b;*
Figure 11B:
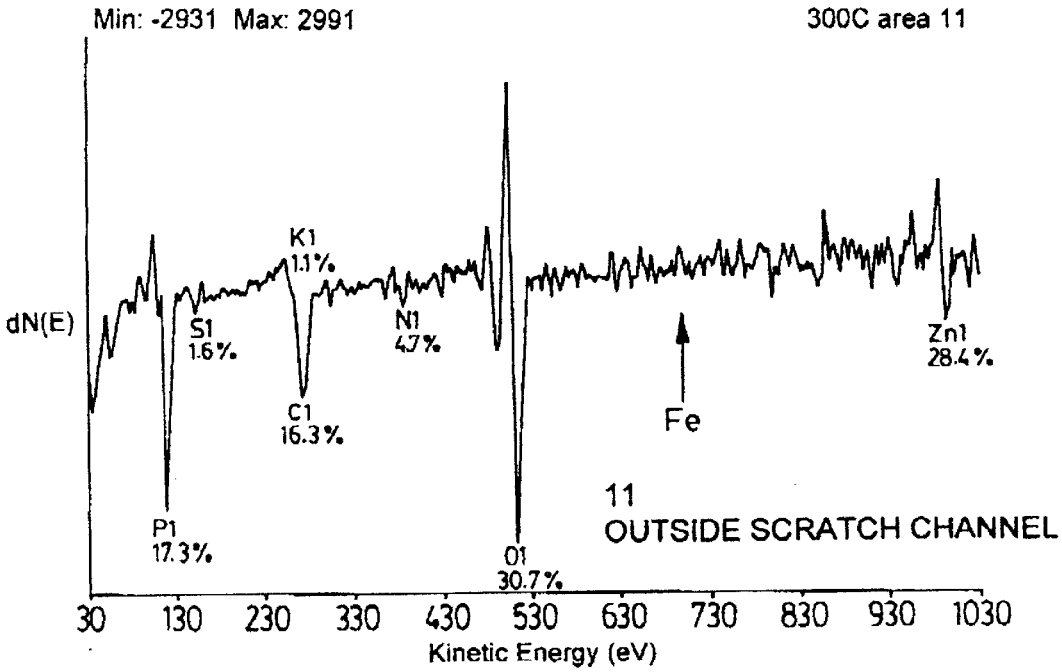
FIG. 11*b* is a plot of Auger spectra on the samples shown in FIG. 10.
Figure 11B:
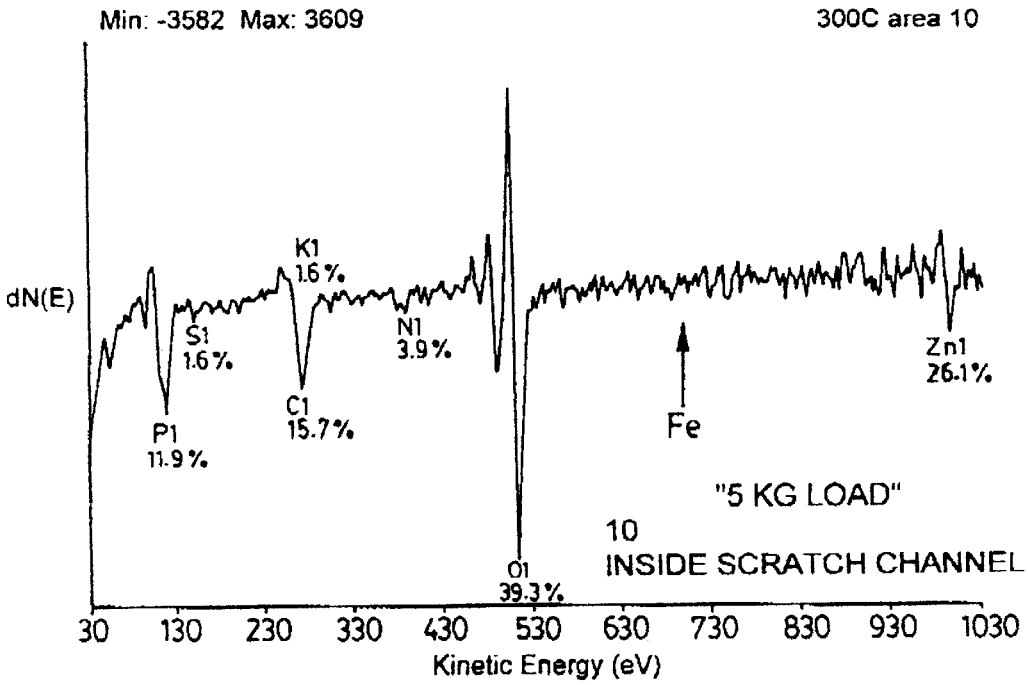

Auger Emission Spectroscopy (AES) and Energy Dispersive X-ray Analysis (EDX) were performed on the scratch tested samples. AES is a surface sensitive technique, with an analysis depth of approximately 50 Å. AES analysis was done using a spot size of approximately 1 μm, inside and outside the scratch channels. Results for the 5 kg load scratch test are shown in FIG. 11. The numbers on the SEM photo at the top of the figure indicate the analysis spots. The spectra for regions 11, outside the scratch channel, and 10, inside the 5 kg load scratch channel are shown. The spectra both inside and outside the scratch channel indicate the presence of P (~130 eV) and the absence of the Fe signals (~700 eV). This implies that the phosphate has not been removed, exposing the steel substrate.

Figure 12A:
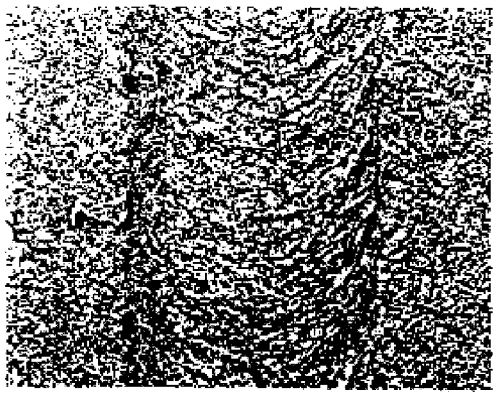
FIGS. 12*a*, 12*b*, 12*c*, 12*d* and 12*e* are views of Energy Dispersive X-ray analysis generated elemental maps of selected thermal films after another scratch test.
Figure 12B:
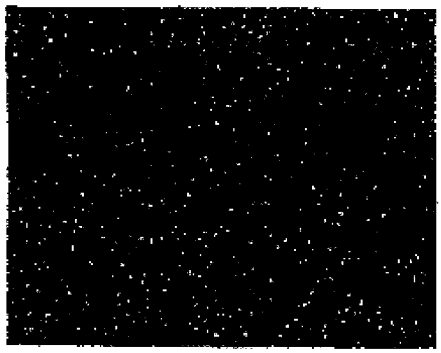
Figure 12D:
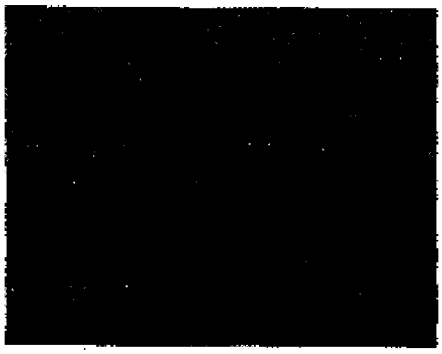
Figure 12C:
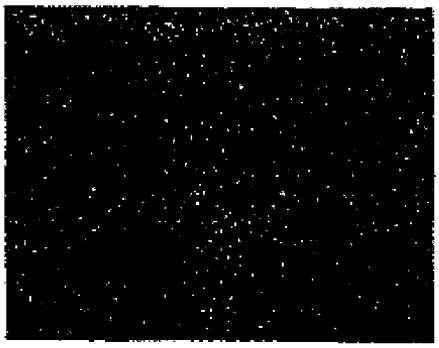
Figure 12E:
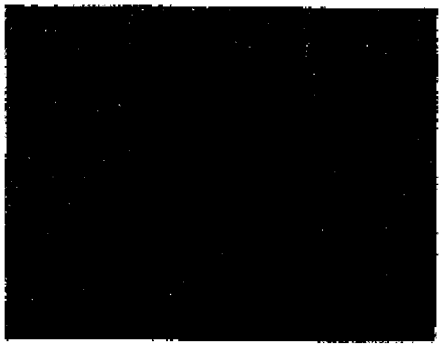

EDX was also performed on the sample scratch tested at approximately a 6 kg load. EDX is a bulk sensitive technique with an analysis depth of approximately 1 μm at the energy used in this analysis. The EDX elemental maps are shown in FIGS. 12(*b–e*) and indicate the spatial distribution of the particular element over the analyzed area shown in the SEM in (a). Since EDX is a bulk sensitive technique, it is not surprising to see the presence of Fe over the tested area, although lack of intensity at the edges of the scratch channel does indicate the build up of film. The P K map shown in (b) shows that the P is evenly dispersed over the scratch tested area, indicating that the phosphate film is still present within the scratch channel. Zn is associated with the phosphate and is also shown to be distributed evenly over the tested area (FIG. 12*e*). Thus, results of the scratch testing indicate that the annealed thermal film is quite hard and adheres well to the steel substrate.

Tribological (Rubbing) Test

The 300° C. annealed thermal film on steel shown in FIG. 8(*b*) was subjected to a tribological test. The steel coupon and pin, both with annealed film, were placed in a Plint High Frequency wear tester. The pin was loaded at 220N, normally against the coupon, and then reciprocated at 25 Hz against the coupon in base oil (with no ZDDP) at 100° C. for 30 minutes. The coupon and pin were removed from the apparatus and excess oil was gently blotted from the surface with a tissue. Examination of the coupon and pin revealed catastrophic wear. The pin wear scar was measured under an optical microscope using a calibrated grid. Wear scar results are shown in Table 1. P K-edge XANES spectroscopy of the rubbed area on the coupon yielded no signal revealing that the annealed film had been rubbed off. This particular example indicates that, in some cases, the annealed films may not be useful in tribological applications. However, this example does demonstrate the increased hardness of the film as a result of the annealing process. The hard thermal film breaks off and acts as an abrasive between the metal surfaces, causing catastrophic wear.

TABLE 1

Pin wear scar diameter measurements

| Sample History | Wear scar diameter | | |
|---|---|---|---|
| | Range | Mean | Average |
| Annealed Thermal Film (300° C., 1 hour) | 1–2 mm* | 1–2 mm* | 1–2 mm* |
| Blank A2 Steel (no film) | 270–370 (μm)<br>220–310 (μm)<br>250–330 (μm) | 340 (μm)<br>290 (μm)<br>310 (μm) | 310 ± 50 (μm) |

*measured roughly with a ruler because wear scar is very large

It should be noted that the annealing step is believed to harden the film. It is further believed that the hardness of the film increases with annealing temperature. Therefore, tribological tests such as these are expected to yield improved results with changes to the annealing process, for example by reducing the temperature thereof.

Tape Test

The thermal film used in this tape test was prepared by immersing an A2 steel coupon for 6 hours, in a ZDDP oil solution heated at 150° C. In this case, the coupon was immersed for the first 6 hours of ZDDP oil solution heating. This thermal film was annealed at 200° C. for 1 hour prior to tape testing. Carbon tape was first tried in the tape test but it was so sticky that the tape could not be removed off of the film. Copper tape was then used in the tape test. P K-edge XANES analysis was done on the film prior to annealing, after annealing and then on the tape tested area. No change in P K-edge peak height was noted indicating that the tape had not removed any film. P K-edge XANES analysis of the tape after the test showed no signal, confirming these results.

A calibration curve of P K-edge peak height plotted against P areal density determined using PIXE analysis, was used to determine the film thickness. Film thickness was calculated to be ~100 Å, assuming Zn pyrophosphate as the film species with a density of 3.7 g/cm$^3$ . This film thickness of ~100 Å is thinner than the 500 Å film described in FIG. 8. Both thermal films were prepared by a 6 hour immersion in the ZDDP oil solution heated at 150° C., but were immersed at different times into the heating process. Thermal film chemistry and film thickness have been shown to depend upon ZDDP oil solution chemistry and length of immersion time. Therefore, it may be important, in some cases, to know the ZDDP oil solution heating time (solution chemistry) and the length of time the samples were immersed in the heated ZDDP oil solution. In this case, the thickness is believed to have been affected by the decomposition of the ZDDP.

Humidity Testing of Annealed Thermal Film on Al Alloy Against Blank Al Alloy (No Film)

Figure 13A:
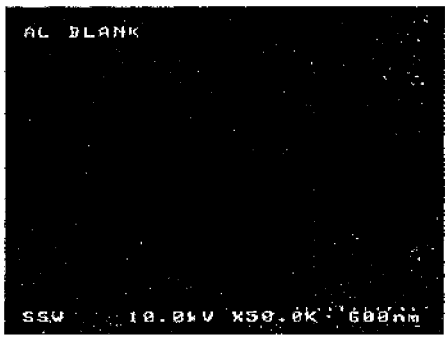
Figure 13C:
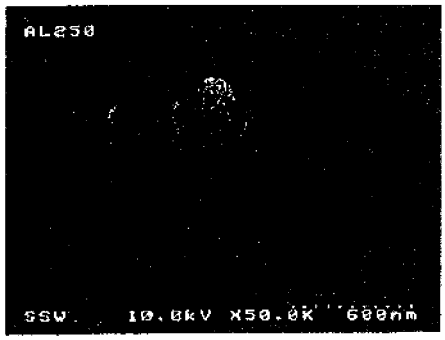

An annealed phosphate thermal film was tested in a humid environment against an Al alloy blank coupon with no film. The coupons were suspended for 23 hours over de-ionized water, heated at a temperature of 85° C. The coupons were removed and allowed to air dry. Visual inspection of the blank coupon after testing indicated the presence of a white material on the surface. On the other hand, the coupon initially coated with the annealed film had not changed in appearance, at least not visually. Scanning electron microscopy was used to take a closer look at the coupon surfaces. SEM micrographs of the blank Al alloy coupon and annealed phosphate film on Al alloy, before and after humidity testing, are presented in FIG. 13. Large crystals (microns in size) of what are believed to be hydroxide crystals, are seen on the surface of the blank Al alloy coupon after humidity testing (comparing FIGS. 13*a*) to *b*)). Although some dissolution of the annealed film has occurred, as indicated by the change in appearance of the film in the SEM photos (comparing FIGS. 13*c*) to *d*)), the growth of the large hydroxide crystals was prevented. The thickness of the film, before and after humidity testing, was determined using P K-edge XANES spectroscopy and Particle Induced X-ray Emission (PIXE) analysis. The film thickness had decreased from 1400 to 600 Å, confirming the SEM results. Thus, although the film does dissolve to a certain extent, the presence of an annealed phosphate film on an Al alloy in a humid environment is still an improvement over no film.

Chemical Treatments of the Annealed Films on Gold

Thermal films were prepared on gold foil by immersing the gold in a ZDDP oil solution for the first 48 hours of heating at 150° C. These thermal films on gold were then annealed at 300° C. for 1 hour. The annealed and unannealed thermal films were then subjected to various chemical treatments.

Comparison of Annealed and Unannealed Thermal Film Thickness on Gold Foil, Before and After Sonication in De-ionized Water for 5 and 30 Minutes P K-edge XANES spectroscopy was used to monitor the film thickness. As described earlier (section 1.4.1.3), film thickness was determined using a calibration curve of P K-edge peak height plotted against P areal density. P areal density was obtained by PIXE analysis. Film thickness was calculated from the extrapolated P areal density, assuming Zn pyrophosphate as the film species, having a density of 3.7 g/cm$^3$.

Prior to sonication in water, the annealed and unannealed thermal films were analysed at the P K-edge, using XANES spectroscopy. The films were then suspended in a beaker containing deionized water, and were sonicated for 5 minutes. The films were rinsed with methanol and were allowed to air dry. P K-edge XANES spectra were then obtained on the films. The same films were resuspended in water, and further sonicated for 25 minutes, a total of 30 minutes of sonication in deionized water. P K-edge XANES spectra were again obtained on the films. The resulting change in film thickness with sonication time is presented in FIG. 14.

Figure 14:
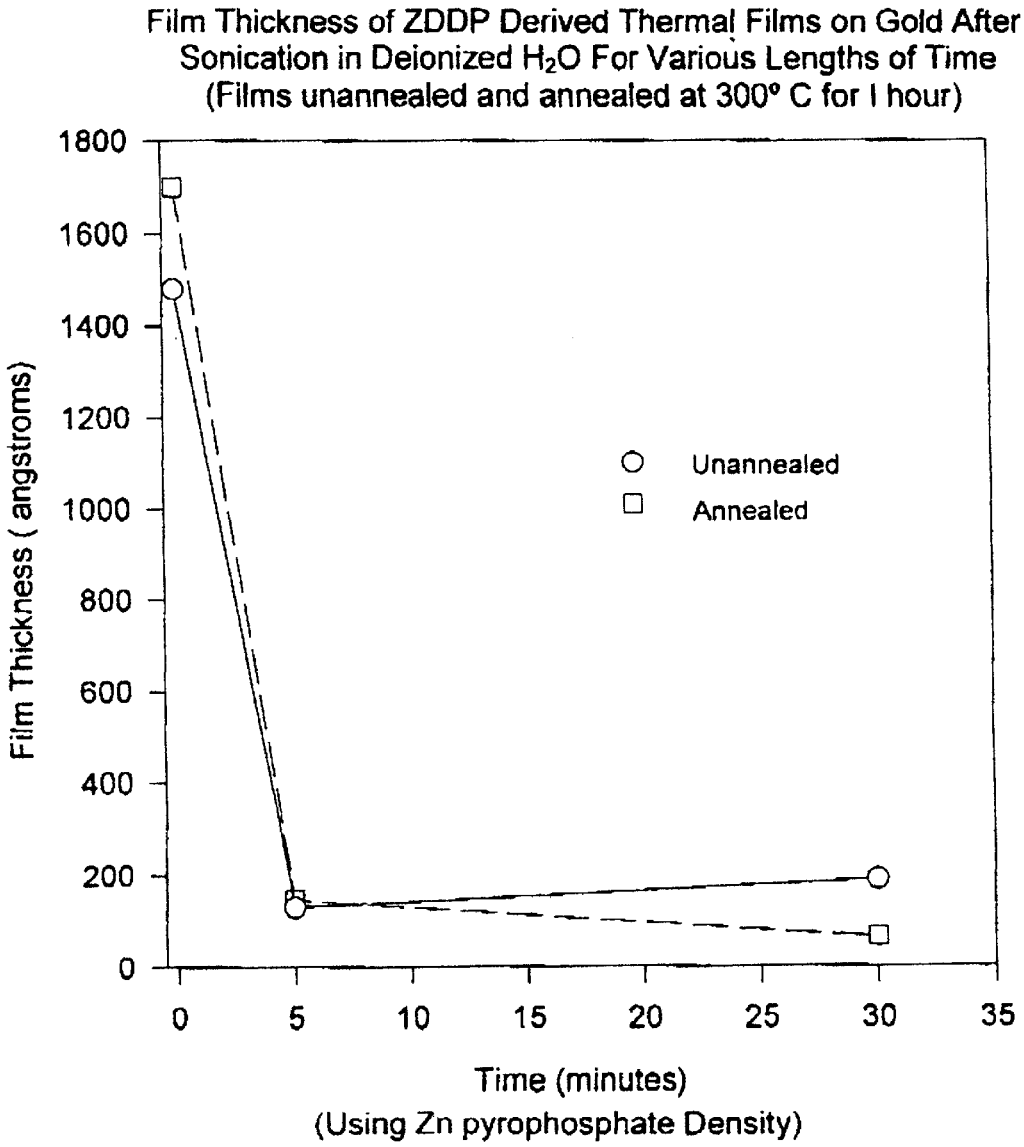
FIG. 14 is a plot of film thickness versus time for a particular test of selected thermal films.

As can be seen in FIG. 14, the films, prior to sonication, are close to 2000 Å in thickness. The film thickness of both the unannealed and annealed films decreases dramatically to 100 Å after only 5 minutes of sonication. No further dramatic decrease in film thickness is noted after 25 minutes of sonication.

Figure 15:
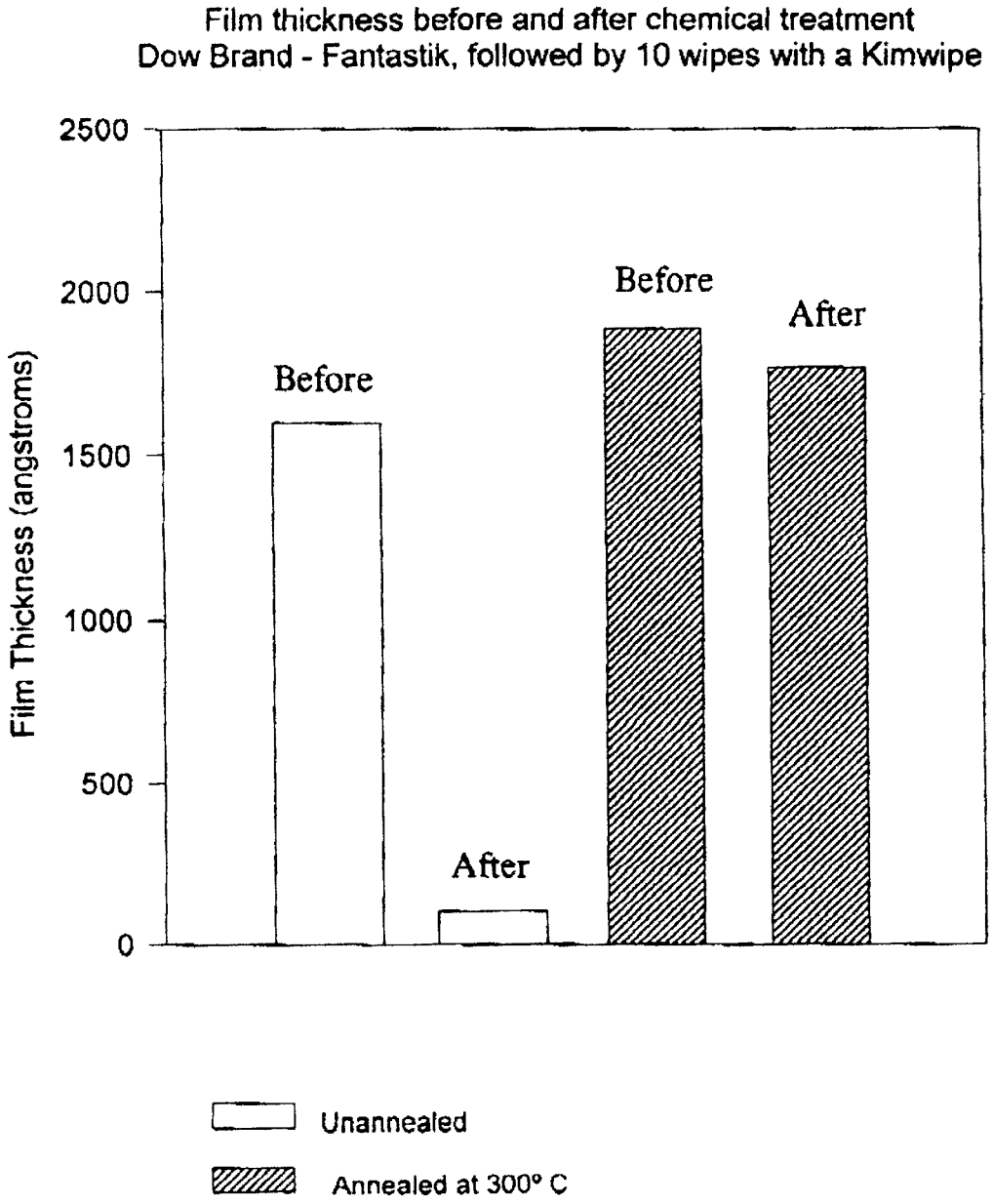
FIG. 15 is another plot of film thickness for a particular test of selected thermal films.

Comparison of Annealed and Unannealed Thermal Film Thickness on Gold Foil, Before and After Treatment with "Fantastik" (a Trademark) and Wiping with Tissues The annealed and unannealed thermal films were both treated with 1 squirt of Dow brand "Fantastik" (a Trademark) cleaner, and then wiped 10 times with a tissue. P K-edge XANES spectroscopy was again used to monitor any change in film thickness. Film thickness before and after treatment are shown in FIG. 15. FIG. 15 reveals that the unannealed film is less stable to this treatment than its annealed counterpart. Much of the unannealed film was wiped away, while there was very little change in the annealed film thickness.

Protective Film Formation on Non-metallic Substrates.

Figure 16:
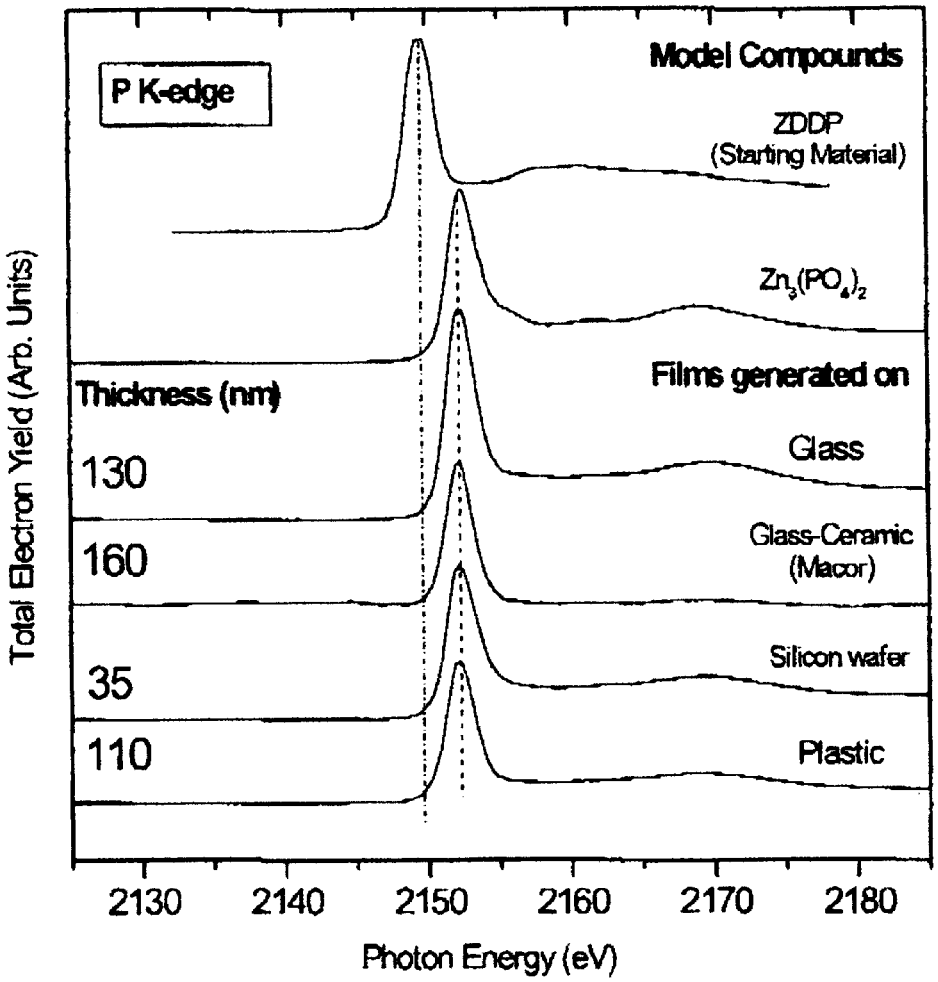
FIG. 16 is another plot of film thickness for a number of thermal films.

As has been stated above, thermal films according to one aspect of the present invention have been successfully made on such metals as steel, aluminum, gold and silver, using zinc dialkyldithiophosphates (ZDDP). Recent work indicates that thermal films may also be applied to non-metallic substrates including glasses, ceramics, silicon and plastics. In the latter case, it is contemplated that a number of plastics may be suitable candidates for receiving the thermal film, including thermoset, thermoplastic materials and such plastics as NYLON and TEFLON (both of which are trademarks) which may, in some cases, be capable of withstanding the temperatures associated with the heated oil solution and the annealing environment. FIG. 16 presents the P K-edge XANES spectra of the ZDDP derived thermal films on non-metallic substrates, along with zinc phosphate and ZDDP model compound spectra. The film spectra are very similar to the Zn phosphate spectrum. These results are consistent with results obtained using metal substrates and present a film thickness in the same range as found using the metal substrates, except in the case of Si which, as shown in FIG. 16, had a thickness of 35 nm.

Coating Time Reduction

In earlier examples, a thermal film having a 200 nm thickness required that the substrate be immersed in a 150° C. ZDDP oil solution for about 24 hours. An increase in the oil solution temperature, along with the use of a synthetic oil in conjunction with an antioxidant available under the trade name IRGANOX L 150 has resulted in the reduction of time required to generate a film of comparable thickness. As Table 1 indicates, the coating time has been reduced to 4 hr, as a result of increasing the concentration of ZDDP to 6%, and increasing the oil solution temperature to 190° C. In this case, the oil was a synthetic oil called polyalphaolefin, also referred to as "PAO", for example PAO 4, where the 4 indicates the viscosity (approx. 4 cSt @ 100C). However, as shown in table 1, the process uses considerably more ZDDP, in this case about five times as much. In addition, the results indicate that forming thermal films in heated oil solutions at a higher temperature, in this case 190° C., without the presence of the antioxidant was accompanied by deterioration of the oil, as seen by a slight discolouration and which may cause some adverse effects on the film properties.

Additional results have shown that a thick film may, in some cases, be generated in 2 hours, by using a 3% ZDDP oil solution, heated at 190° C.

It will be understood that other synthetic oils may be applicable suitable, as well as other viscosities and environmental conditions the coating process as herein described.

TABLE 1

| Film Generation Conditions | | | | |
|---|---|---|---|---|
| Oil | ZDDP (%) | Temperature (C.) | Time (hr) | thickness (nm) |
| MCT10 | 1.2 | 150 | 24 | 200 |
| MCT10 | 1.2 | 190 | 4 | 175 |
| MCT 10 | 6 | 150 | 24 | 280 |
| MCT10 | 6 | 190 | 4 | 175 |
| PA04 | 1.2 | 150 | 24 | 120 |
| PA04 | 1.2 | 190 | 4 | 150 |
| PA04 + antioxidant (0.3%) | 1.2 | 150 | 24 | 11 |
| PA04 + antioxidant (0.3%) | 1.2 | 190 | 4 | 150 |

(A)

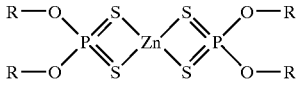

(B)

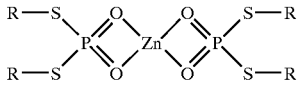

Where R = $C_1$–$C_{20}$

What is claimed is:

1. A substrate with an annealed film of ZDDP derivative material thereon, the substrate being reactive to ZDDP, the coating formed by exposing the substrate to a solution containing ZDDP for a sufficient period of time and at a temperature not exceeding 200 degrees Celsius, so as to cause said ZDDP to thermally decompose to form a film on said substrate, withdrawing said substrate from the solution and thereafter annealing said film, wherein the substrate includes thermoset or thermoplastic materials.

2. A substrate with an annealed film of ZDDP derivative material thereon, the substrate being reactive to ZDDP, the coating formed by exposing the substrate to a solution containing ZDDP for a sufficient period of time and at a temperature not exceeding 200 degrees Celsius, so as to cause said ZDDP to thermally decompose to form a film on said substrate, withdrawing said substrate from the solution and thereafter annealing said film wherein the substrate includes NYLON or TEFLON.

3. A substrate with an annealed film of ZDDP derivative material thereon, the substrate being reactive to ZDDP, the coating formed by exposing the substrate to a solution containing ZDDP for a sufficient period of time and at a temperature not exceeding 200 degrees Celsius, so as to cause said ZDDP to thermally decompose to form a film on said substrate, withdrawing said substrate from the solution and thereafter annealing said film, wherein the substrate includes glass ceramic materials.

* * * * *